US009567137B2

(12) United States Patent
Peng

(10) Patent No.: US 9,567,137 B2
(45) Date of Patent: Feb. 14, 2017

(54) REVERSAL-TYPE LIQUID MEASURING DEVICE AND BOTTLE ASSEMBLY HAVING THE SAME

(71) Applicant: Shi Peng, Shenzhen (CN)

(72) Inventor: Shi Peng, Shenzhen (CN)

( * ) Notice: Subject to any disclaimer, the term of this patent is extended or adjusted under 35 U.S.C. 154(b) by 37 days.

(21) Appl. No.: 14/552,069

(22) Filed: Nov. 24, 2014

(65) Prior Publication Data

US 2015/0076101 A1 Mar. 19, 2015

Related U.S. Application Data

(63) Continuation-in-part of application No. 13/515,814, filed as application No. PCT/CN2010/074728 on Jun. 29, 2010, now abandoned.

(30) Foreign Application Priority Data

Jan. 22, 2010 (CN) ..... 2010 1 0109894

(51) Int. Cl.
*G01F 11/26* (2006.01)
*B65D 25/48* (2006.01)

(52) U.S. Cl.
CPC ..... *B65D 25/48* (2013.01)

(58) Field of Classification Search
CPC ..... G01F 11/26; G01F 11/261–11/265; G01F 11/267; G01F 11/268; A47G 19/34; B65D 25/52
See application file for complete search history.

(56) References Cited

U.S. PATENT DOCUMENTS

| | | | | |
|---|---|---|---|---|
| 1,297,244 | A * | 3/1919 | Rauen | G01F 11/261 222/455 |
| 2,977,028 | A * | 3/1961 | Joffe | G01F 11/262 222/442 |
| 4,061,253 | A * | 12/1977 | Rockefeller | G01F 11/262 222/442 |
| 5,148,953 | A * | 9/1992 | Fudalla | G01F 11/262 222/442 |
| 5,480,071 | A * | 1/1996 | Santagiuliana | G01F 11/261 220/254.2 |
| 5,556,011 | A * | 9/1996 | Jennings | B65D 83/06 141/325 |
| 9,395,225 | B2 * | 7/2016 | Skillin | G01F 11/262 |
| 2012/0132677 | A1 * | 5/2012 | Hall | G01F 11/262 222/454 |

(Continued)

*Primary Examiner* — Paul R Durand
*Assistant Examiner* — Randall Gruby
(74) *Attorney, Agent, or Firm* — Novoclaims Patent Services LLC; Mei Lin Wong

(57) ABSTRACT

A bottle arrangement includes a bottle body a measuring bucket. The measuring bucket includes a guiding base assembly, a second compartment base, and a top cap. The guiding base assembly includes an inclined first compartment base, an inclined first channel base, an inclined second channel base, and an inclined backflow channel base. The guiding base assembly has a through first inlet opening, a through second inlet opening and a backflow opening. The first inlet opening and the backflow opening communicate with the bottle body. The measuring bucket also includes first through fourth partitioning walls provided on the guiding base assembly to define at least a first compartment, a first communicating channel, a second communicating channel, and a backflow channel.

20 Claims, 26 Drawing Sheets

(56) References Cited

U.S. PATENT DOCUMENTS

| | | | | |
|---|---|---|---|---|
| 2013/0240573 | A1* | 9/2013 | Debski | G01F 11/262<br>222/438 |
| 2014/0197209 | A1* | 7/2014 | Debski | B65D 25/52<br>222/454 |
| 2015/0028063 | A1* | 1/2015 | Skillin | G01F 11/261<br>222/455 |

* cited by examiner

REVERSAL-TYPE LIQUID MEASURING DEVICE AND BOTTLE ASSEMBLY HAVING THE SAME

CROSS REFERENCES TO RELATED APPLICATIONS

This is a Continuation-In-Part application of a non-provisional application having an application number of Ser. No. 13/515,814 and a filing date of Jun. 14, 2012, which is a national phase national application of an international patent application number PCT/CN2010/074728 with a filing date of Jun. 29, 2010 based on a foreign application number 201010109894.X with a filing date of Jan. 22, 2010 in China. The contents of these specifications, including any intervening amendments thereto, are incorporated herein by reference.

BACKGROUND OF THE PRESENT INVENTION

Field of Invention

The present invention relates to a measuring device, and more particularly to a bottle arrangement comprising an overturning device which is capable of measuring and dispensing fluid.

Description of Related Arts

A conventional bottle arrangement usually comprises a bottle body and an overturning device provided on the bottle for measuring and dispensing fluid. The overturning device is equipped with a measuring chamber. The bottle arrangement achieves measuring, storing, and discharging of fluid by overturning a bottle body several times. A major disadvantage of this type of conventional overturning device is that although the measuring chamber is provided to achieve measuring, storing and discharging of fluid, there is no calibration structure of any kind in the measuring chamber. Since the amount of the fluid stored in the bottle body is varied, the speed and angle for a user to overturn the device will also be varied. As a result, it is very hard to ensure that the fluid coming out from the bottle arrangement is of the same volume each time a measuring and dispensing step are performed. In other words, the conventional bottle arrangement as described above lacks sufficient accuracy which severely affects its practicability.

SUMMARY OF THE PRESENT INVENTION

An objective of the present invention is to provide a bottle arrangement comprising an overturning device which is capable of measuring and dispensing fluid in a correct volume.

In one aspect of the present invention, it provides a bottle arrangement, comprising:

a bottle body having a receiving chamber for storing a predetermined amount of liquid, and a bottle opening;

a measuring bucket having an overturning side and an opposed backflow side, and comprising:

a guiding base assembly which comprises an inclined first compartment base, an inclined first channel base, an inclined second channel base, and an inclined backflow channel base, the guiding base assembly having a through first inlet opening, a through second inlet opening, a backflow opening, a first communicating opening, and a second communicating opening, the first inlet opening and the backflow opening communicating with the receiving chamber of the bottle body;

first through fourth partitioning walls provided on the guiding base assembly to define at least a first compartment having the first compartment base, a first communicating channel having the first channel base, a second communicating channel having the second channel base, and a backflow channel having the backflow channel base, the first communicating channel and the second communicating channel being formed at a position sandwiched by the first compartment, while the backflow channel being formed at a position between the first communicating channel and the second communicating channel, the backflow opening being formed on the backflow channel base at the backflow side of the measuring bucket, the first communicating opening communicating the first compartment with the first communicating channel, the second communicating opening communicating the first compartment with the second communicating channel;

a second compartment base downwardly extended from the guiding base assembly, the second compartment base having a second compartment communicating with the second inlet opening of the guiding base assembly; and a top cap having a sealing portion and a through flow guiding opening formed thereon, the flow guiding opening has a longitudinal axis aligning with that of the second inlet opening;

whereby, the bottle arrangement is arranged to be sequentially operated in three positions for discharging a predetermined amount of the liquid stored in the receiving chamber;

wherein in the first position, the bottle arrangement is flipped towards the overturning side, and the liquid stored in the receiving chamber is arranged to flow into the first compartment through the first inlet opening;

wherein in the second position, the bottle arrangement is flipped towards the backflow side so as to allow the bottle arrangement to stand vertically, the liquid in the first compartment is guided by the first compartment base to flow through the first communicating channel, the second communicating channel, the second inlet opening and eventually stored in the second compartment of the second compartment base, excessive liquid from the second compartment is arranged to be guided to return to the receiving chamber through flowing through the backflow channel and the backflow opening; and wherein in the third position, the bottle arrangement is again flipped towards the overturning side, so that the liquid stored in the second compartment is arranged to be guided to flow through the second inlet opening and the flow guiding opening of the top cap and is discharged out of the bottle arrangement.

One skilled in the art will recognize that these steps may in some circumstances be augmented, rearranged, omitted, and/or substituted, with no loss of function with respect to application in the field of the present invention.

DETAILED DESCRIPTION OF THE PREFERRED EMBODIMENT

Figure 1:
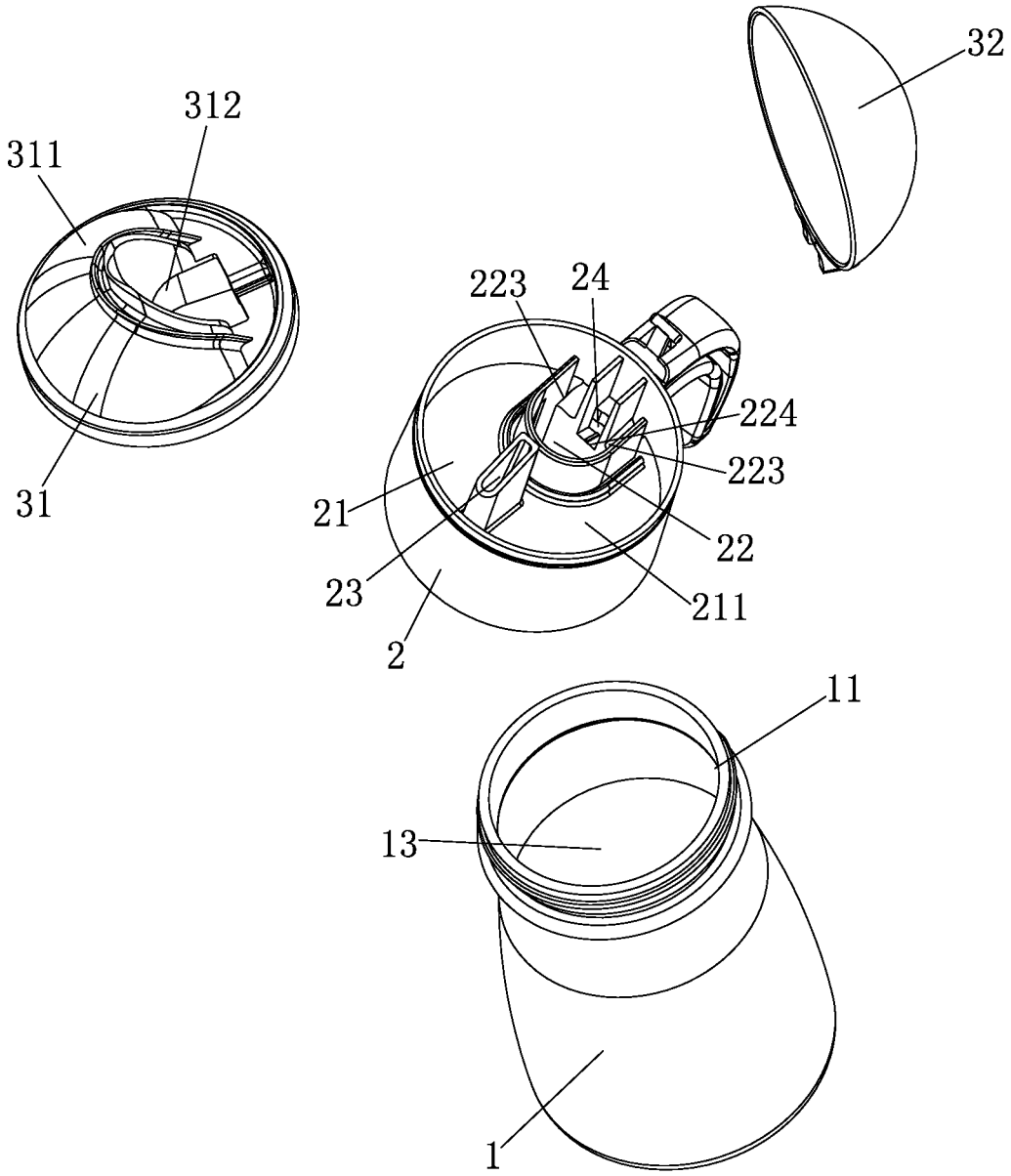
FIG. 1 is a perspective view of a bottle arrangement according to a first preferred embodiment of the present invention.
Figure 2:
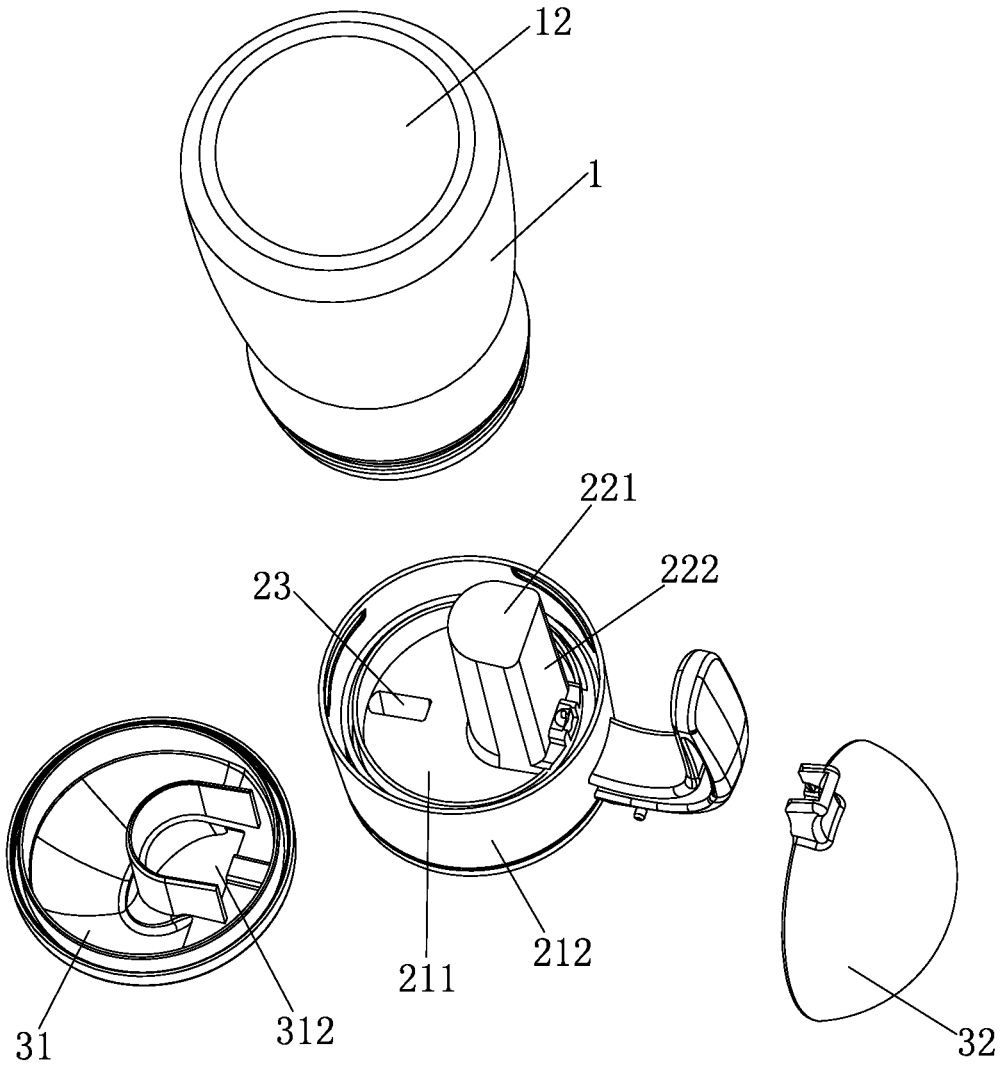
FIG. 2 is another perspective view of the bottle arrangement according to the first preferred embodiment of the present invention.
Figure 3:
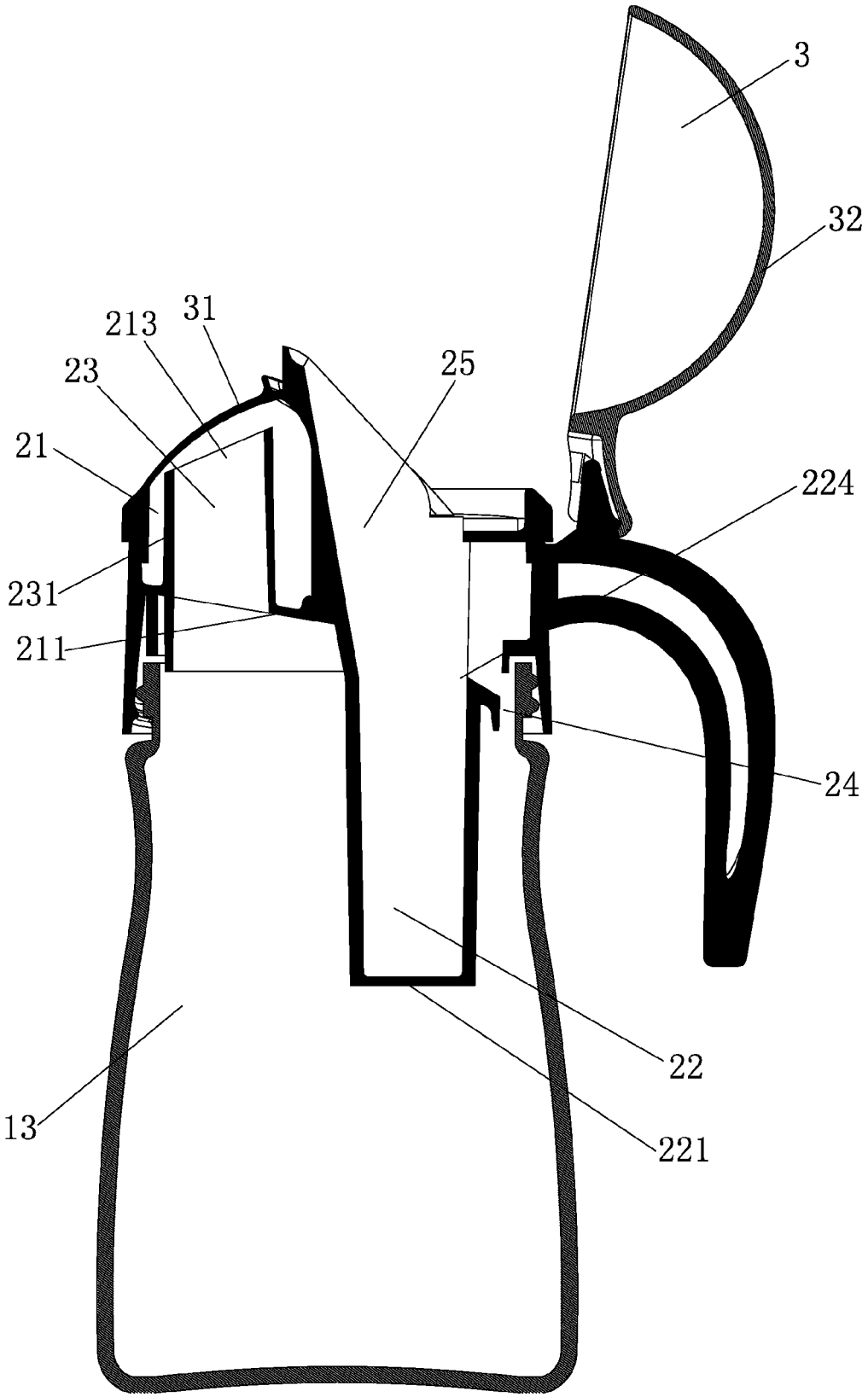
FIG. 3 is a sectional view illustrating the bottle arrangement when the second top cap is being opened according to the first preferred embodiment of the present invention.
Figure 4:
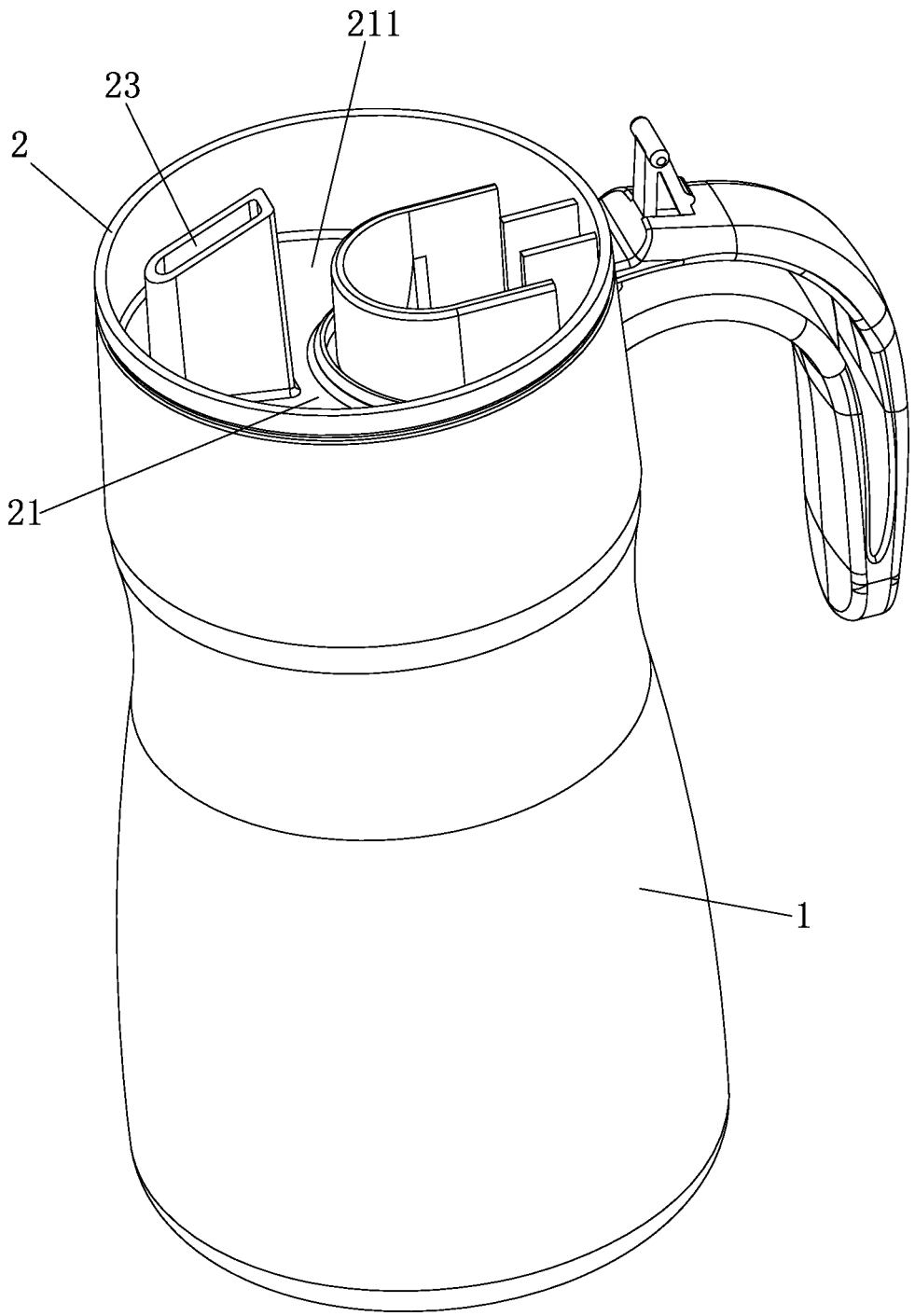
FIG. 4 is a perspective view illustrating the bottle arrangement without the top cap according to the above first preferred embodiment of the present invention.

The following description is disclosed to enable any person skilled in the art to make and use the present invention. Preferable embodiments are provided in the following description only as examples and modifications will be apparent to those skilled in the art.

The general principles defined in the following description would be applied to other embodiments, alternatives, modifications, equivalents, and applications without departing from the spirit and scope of the present invention.

Embodiment 1

Referring to FIG. 1 to FIG. 4 of the drawings, a bottle arrangement according to a first preferred embodiment of the present invention is illustrated. The bottle arrangement comprises a bottle body 1, a measuring bucket 2, and a top cap 3. The bottle body 1 has a receiving chamber 13 having a bottle base 12 at a bottom side thereof and a bottle opening 11 at a top side thereof The measuring bucket 2, which is mounted at the bottle opening 11 of the bottle body, has a first compartment 21, a second compartment 22, an inlet channel 23, a backflow channel 24, and a discharge channel 25. The first compartment 21 is defined by a first compartment base 211 and a first compartment wall 212 having a ring-shaped cross section. The first compartment base 211 closes and seals a bottom side of the first compartment wall 212, wherein the compartment wall 212 has an opening 213 provided at a bottom side thereof. The first compartment base 211, which is capable of guiding fluid to flow under the influence of gravity, may have a slanted surface which is inclinedly provided. The second compartment 22 is defined by a second base 221 and a second compartment wall 222 having a ring-shaped cross section. The second compartment wall 222 has an inlet opening 223 and a backflow opening 224 which are provided above the second compartment base. A position of the inlet opening 223 is not lower than a position of the backflow opening 224, preferably the position of the inlet opening 223 is higher than the position of the backflow opening 224. The inlet opening, which is provided at a lower position of the first compartment, facilitates the fluid to flow from the first compartment into the second compartment. The inlet channel can be provided a lower position of the first compartment. By providing the backflow opening, the second compartment is constructed to have a predetermined volume. The inlet channel 23, which is defined by a third wall 231 having a ring-shaped cross section, is arranged in an up-down penetration manner and has a bottom opening communicated with the receiving chamber. The inlet channel 23 has a top opening provided at a position higher than the second compartment wall. The third compartment wall 231 can be integrated with the first compartment base 211. The backflow channel 24 communicates the backflow opening to the receiving chamber of the bottle body. The discharge channel 25 through which the fluid in the second compartment 22 is discharged is provided above the second compartment. The inlet channel 23 and the backflow channel 24 are respectively provided at two sides of the second compartment 22.

The top cap 3 comprises a first top cap 31 and a second top cap 32. The first top cap 31, which is capped above the measuring bucket 2, has a sealing portion 311 and a discharge opening 312. The sealing portion 311 closes and seals the top opening 213 of the first compartment 21 and the top opening of the inlet channel 23. The discharge opening communicates the discharge channel to outside. The second top cap 32, which is capped above the first top cap 31, can be rotatably coupled with bottle body 1. The second top cap 32 has a close position at which the second top cap 32 closes and seals the discharge opening for cutting off the communication between the discharge channel and the outside (i.e. the fluid cannot exit therethrough) and an open position at which the second top cap 32 moves away from the discharge opening so that the discharge channel is communicated with the outside (i.e. the fluid can exit therethrough), the "outside" herein is referred to the outside environment of the bottle arrangement.

In an initial state, the fluid is stored in the receiving chamber 13 and the bottle arrangement is in an upright state. At this time, the bottle arrangement can be vertically placed. When dispensing the fluid, the bottle arrangement is overturned for a first time and during the overturning process, the first top cap 31 is capped on the measuring bucket 2, the second top cap 32 is capped on the first top cap 31. When the measuring bucket 2 is overturned to be in an upside-down state, under the influence of gravity, the fluid in the receiving chamber 13 flows into the first compartment 21 through the inlet channel 23. And then, the bottle arrangement is overturned for a second time so that the measuring bucket 2 is back to the upright state, under the influence of gravity, the fluid in the first compartment 21 is guided along the first compartment base 211 flow into the second compartment 22 through the inlet opening. During the flowing process, when the first compartment 21 is full of fluid (i.e. amounts to the predetermined volume of the first compartment 21), the fluid continually flowing into the first compartment 21 flows back into the receiving chamber through the backflow opening 224 and the backflow channel 24. Finally, the bottle arrangement is overturned for a third time and during the overturning process, the second top cap 32 is opened, the measuring bucket 2 is overturned to be in the upside-down sate, the fluid in the second compartment exits to the outside through the discharge channel 25 under the influence of gravity. At the same time, the fluid in the receiving chamber 13 refills the first compartment 21.

By providing the backflow opening and the backflow channel, the surplus fluid is back flowed so that a precise measuring and dispensing of the fluid is obtained. Since the fluid in the measuring bucket is simultaneously undergoing the discharging process and the charging process, the entire charging-discharging process is coherent and the efficiency is increased.

According to the bottle arrangement of this preferred embodiment, the measuring bucket has an upright state in which the fluid in the first compartment is capable of flowing into the second compartment and an upside-down state in which the fluid in the first compartment cannot flow into the second compartment. When in the upright sate, in a direction of gravity, the measuring bucket and the bottle opening of the bottle body are facing upward, the word "upward" herein comprises directions of vertically upward and inclinedly upward; when in the upside-down state, the measuring bucket and the bottle opening of the bottle body are facing downward, the word "downward" herein comprise directions of inclinedly downward and vertically downward. The first compartment through which a temporary storage of the fluid is obtained can be interpreted as a temporary storing compartment; the second compartment through which a precise measure and dispense of the fluid is obtained can be interpreted as a measuring and dispensing compartment. The inlet channel, which communicates the bottle body with the first compartment, is constructed as a passage route for the fluid to flow from the receiving chamber into the first compartment. The first compartment is communicated with the inlet opening of the second compartment. The backflow channel, which communicates the backflow opening to the receiving chamber of the bottle body, is embodied as a passage route for the fluid to flow from the inlet opening into receiving chamber of the bottle body. The discharge channel communicates the second compartment to outside. The inlet channel and the first compartment together form an integral inlet passage communicating the bottle body to the second compartment. A volume of the first compartment can be larger than a volume of the second compartment.

Embodiment 2

Figure 5:
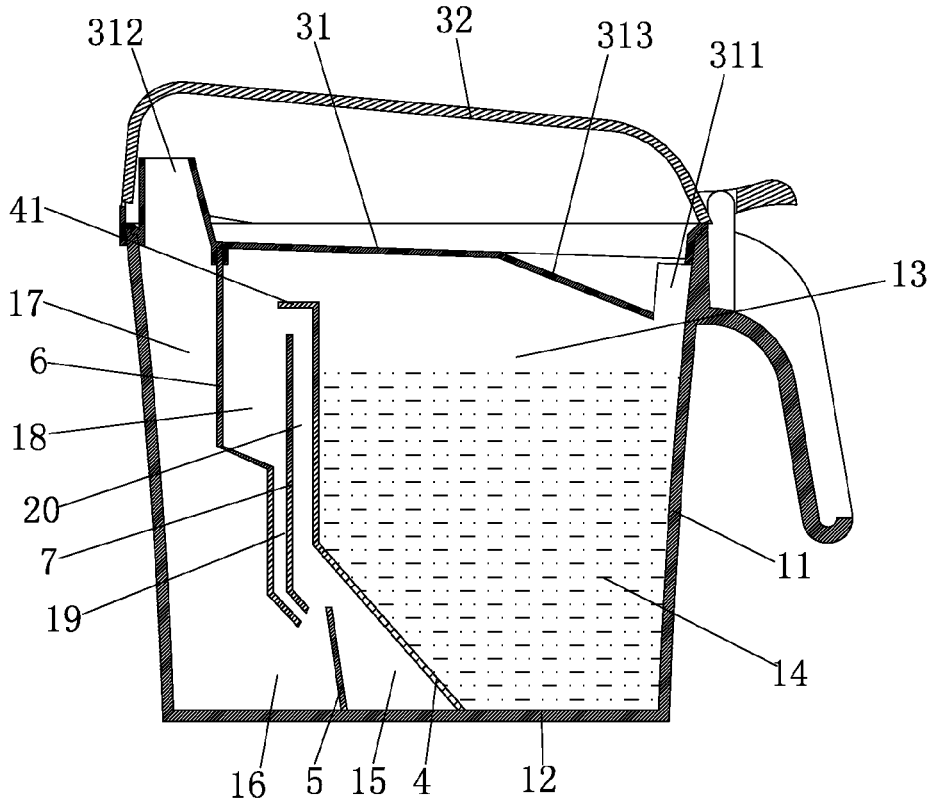
FIG. 5 is a sectional view illustrating a bottle arrangement in an upright state according to a second preferred embodiment of the present invention.
Figure 6:
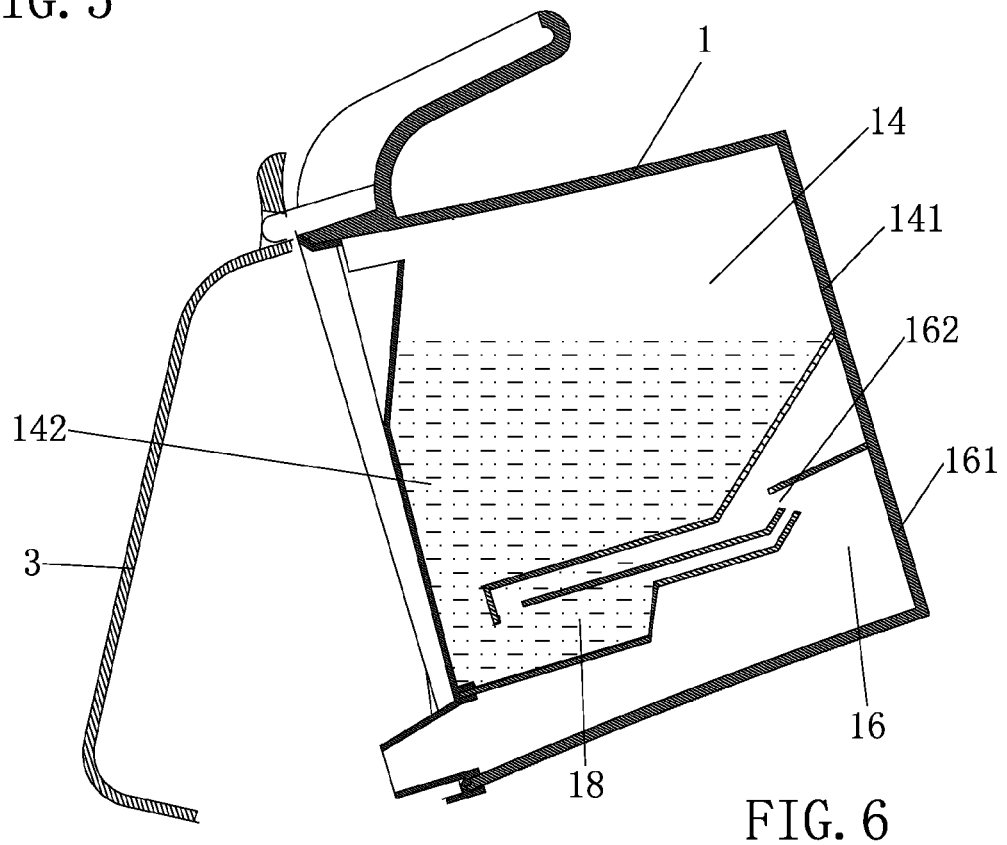
FIG. 6 is a sectional view illustrating the bottle arrangement in an upside-down state according to the second preferred embodiment of the present invention.

Referring to FIG. 5 and FIG. 6 of the drawings, a bottle arrangement according to a second preferred embodiment comprises a bottle body 1 comprising a bottle wall 11, a bottle base 12. A receiving chamber 13 is enclosed and defined by the bottle wall and the bottle base 12. A first partition panel 4, a second partition panel 5, a third partition panel 6, and a fourth partition panel 7 are provided in the receiving chamber 13. The first partition panel 4 is extended upward from the bottle base 12 and is mounted to the bottle wall 11. The second partition panel 5 is extended upward from the bottle base 12 and is mounted to the bottle wall 11. The third partition panel 6 is extended downward from the bottle wall 11 and is mounted to the bottle wall 11. The fourth partition panel 7 is mounted to the bottle wall and is provided between the first partition panel 4 and the third partition panel 6. The first partition panel 4, the bottle base 12 and the bottle wall are enclosed to define a receiving cavity 14 having a first bottom portion 141 at a bottom side thereof and a first opening 142 at a top side thereof. The first partition panel 4, the second partition panel 5, the bottle base 12, and the bottle wall 11 are enclosed to define a first backflow cavity 15 having a closed bottom side. The second partition panel 5, the bottle base 12, and the bottle wall 11 define a measuring-dispensing cavity 16. The third partition panel 6 and the bottle wall 11 are enclosed to define a discharge passage 17. The first partition panel 4, the fourth partition panel 7, and the bottle wall 11 are enclosed to define a second backflow cavity 20 which is arranged in an up-down penetration manner. The fourth partition panel 7, the third partition panel and the bottle wall 11 are enclosed to define a temporary storing cavity 18 and a communicating channel 19 which is provided under the temporary storing cavity 18 for communicating the temporary storing cavity 18 to the measuring-dispensing cavity 16. The second backflow cavity 20 is communicated with the first backflow cavity 15. The measuring-dispensing cavity 16, which has a predetermined volume, has a second bottom portion 161 at a bottom side thereof and a backflow opening 162 at a top side thereof. The backflow opening 162 is even with the top side of the third partition panel 6. An inner diameter of the temporary storing cavity 18 is larger than an inner diameter of the communicating channel 19, and in a direction of gravity, an upper portion of the temporary storing cavity 18 has a larger inner diameter than an inner diameter of a lower portion thereof. In addition, in order to prevent the fluid in the temporary storing cavity 18 from unintentionally flowing into the second backflow cavity 20, a blocking panel 41 is provided on top of the first partition panel 4 extending towards the third partition panel 6. The first bottom portion and the second bottom portion is respectively a portion of the bottle base of the bottle body.

The temporary storing cavity 18 has a top portion and a bottom portion respectively communicated with the receiving cavity 14 and the communicating channel 19. The bottom portion of the communicating channel 19 is communicated with the measuring-dispensing cavity 16. A top portion and a bottom portion of the discharge passage 17 are respectively communicated to outside and the measuring-dispensing cavity 16. The communicating channel 19 and the temporary storing cavity are partitioned from each other by the fourth partition panel 7 and the second backflow cavity 20. The communicating channel 19 and the temporary storing cavity are partitioned from each other by the third partition panel 6 and the discharge passage 17. The receiving cavity 14 and the first backflow cavity 15 are partitioned by the first partition panel 4. The measuring-dispensing cavity 16 is partitioned from the first backflow cavity 15 by the second partition panel 5.

The end cap 3 comprises a first end cap 31 and a second end cap 32. The first end cap has an inlet opening 311 and a discharge opening 312. A slanted surface 313 is provided in the inlet opening for guiding the filling fluid and preventing the fluid to unintentionally exit the bottle body when the fluid is discharged. The discharge opening 312 is communicated with the discharge passage 17. The first end cap 31 is capped on the bottle body 1. The second end cap 32, which is provided above the first end cap 31, is pivotally connected to the bottle body through a rotation axis and is adapted to move between an open position and a closed position.

When in use, the second end cap is opened, the bottle body is in an upright state, the fluid is filled into the receiving cavity 13 of the bottle body through the inlet opening of the first end cap. When measuring and dispensing the fluid, the bottle body is overturned for a first time so that the bottle body is inclined downward so that the bottle body is in an upside-down state, during the overturning process, part of the fluid in the receiving cavity flows into and fill up the temporary storing cavity 18. And then, the bottle body is overturned again so that the bottle body returns to the upright state. The fluid in the temporary storing cavity falls into the measuring-dispensing cavity 16, the surplus fluid climbs over the thirds partition panel and flows into the first backflow cavity 15 and is temporarily stored therein. And again, the bottle body is overturned, so that the bottle body is back to the state in which the bottle body is inclined arranged for the fluid in the measuring-dispensing cavity 16 to exit the bottle body through the discharge passage 17 and the discharge opening. At the same time, the fluid in the first backflow cavity 15 flows into the temporary storing cavity through the second backflow cavity 20, and part of the fluid in the receiving cavity flows into the temporary storing cavity.

In this second preferred embodiment, the measuring-dispensing cavity 16 has a predetermined volume. When the fluid fills up the measuring-dispensing cavity 16, the surplus fluid overflows into the first backflow cavity 15 and then flows back by means of the first backflow cavity 15 and the second backflow cavity. Since when the fluid is discharged, the fluid in the receiving cavity refills the temporary storing cavity, so that the measuring and dispensing process can be carried out continuously.

In this second preferred embodiment, the first backflow cavity 15 and the second backflow cavity form a backflow passage having a bottom portion, so that the fluid overflowing from the measuring-dispending cavity can be temporary stored in the backflow passage.

In this second preferred embodiment, a volume of the temporary storing cavity is preferred to larger than a volume of the measuring-dispensing cavity.

Embodiment 3

Figure 7:
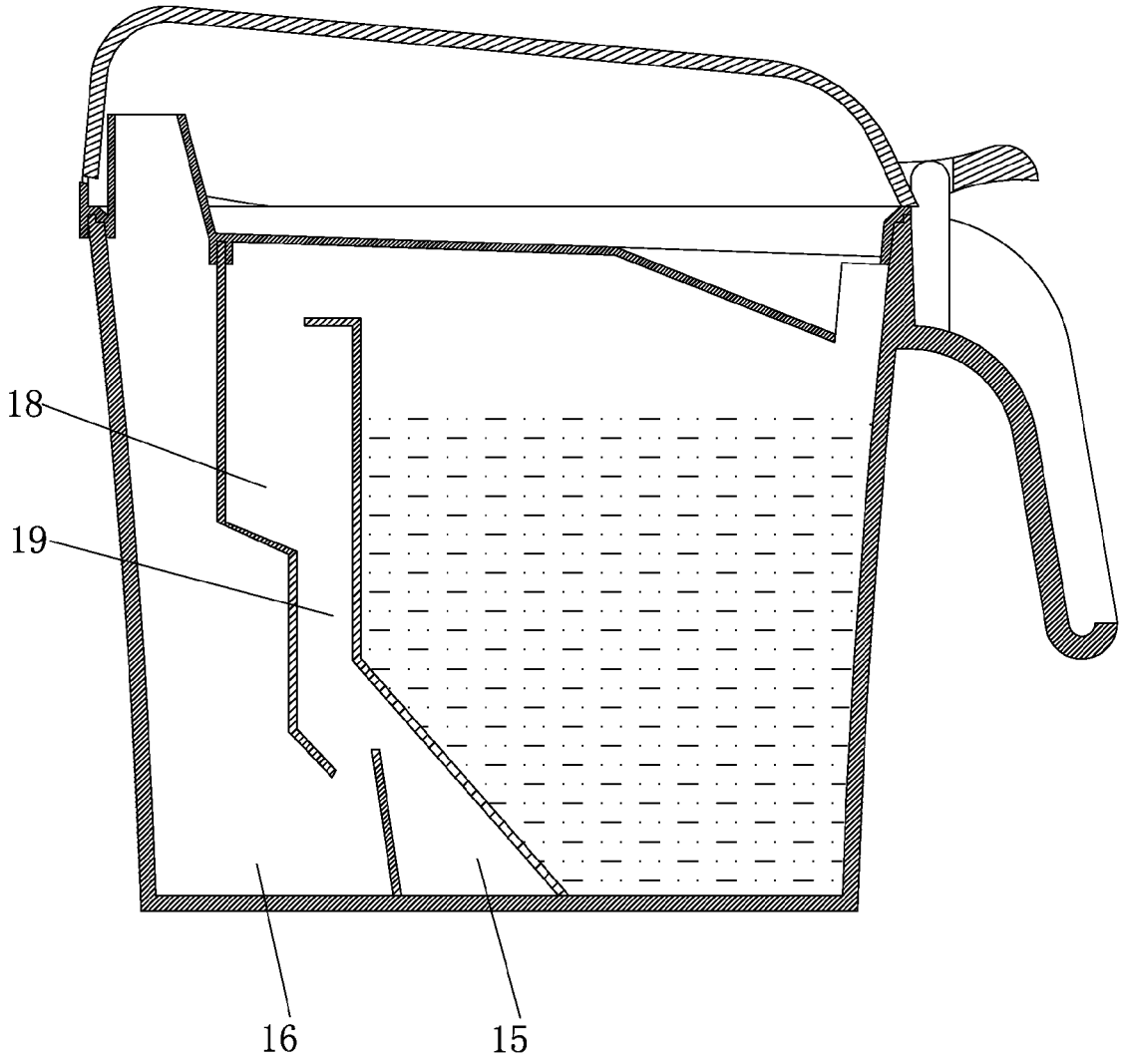
FIG. 7 is a sectional view illustrating a bottle arrangement in an upright state according to a third preferred embodiment of the present invention.

Referring to FIG. 7 of the drawings, the bottle arrangement according to a third preferred embodiment has a similar structure with the bottle arrangement of the second preferred embodiment except the following differences. The fourth partition panel is eliminated in this preferred embodiment. In other words, the first backflow cavity 15 is directly communicated with the temporary storing cavity 16. When filling the fluid, the fluid in the temporary cavity 18 flows into the measuring-dispensing cavity 16 through the communicating channel 19. The surplus fluid in the measuring-dispensing cavity 16 flows into the first backflow cavity 15 for temporary storage. When overturned again, the fluid in the first backflow cavity 15 flows back into the temporary cavity 18 through the communicating channel 19.

Embodiment 4

Figure 8:
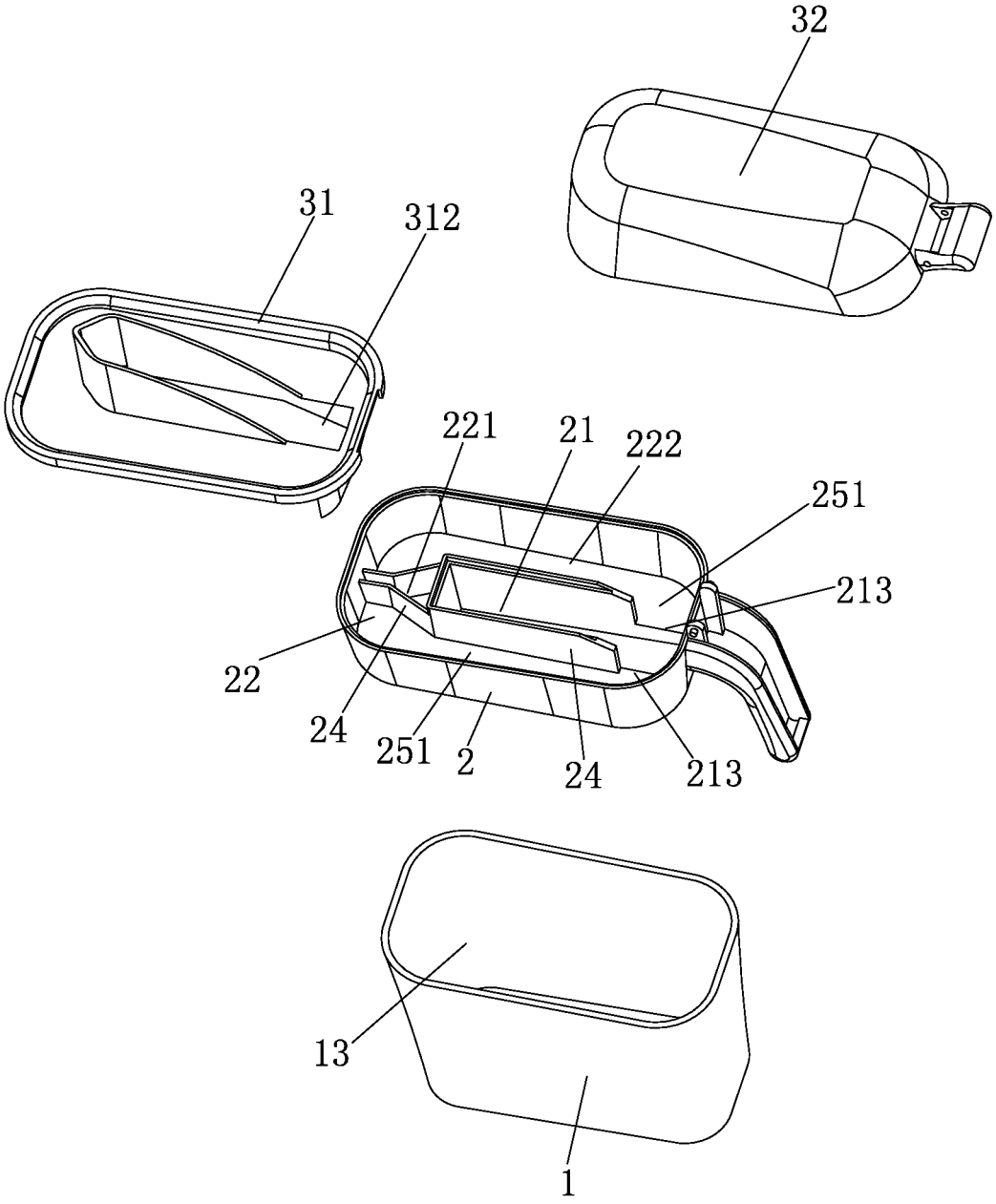
FIG. 8 is an exploded view of a bottle arrangement according to a fourth preferred embodiment of the present invention.
Figure 9:
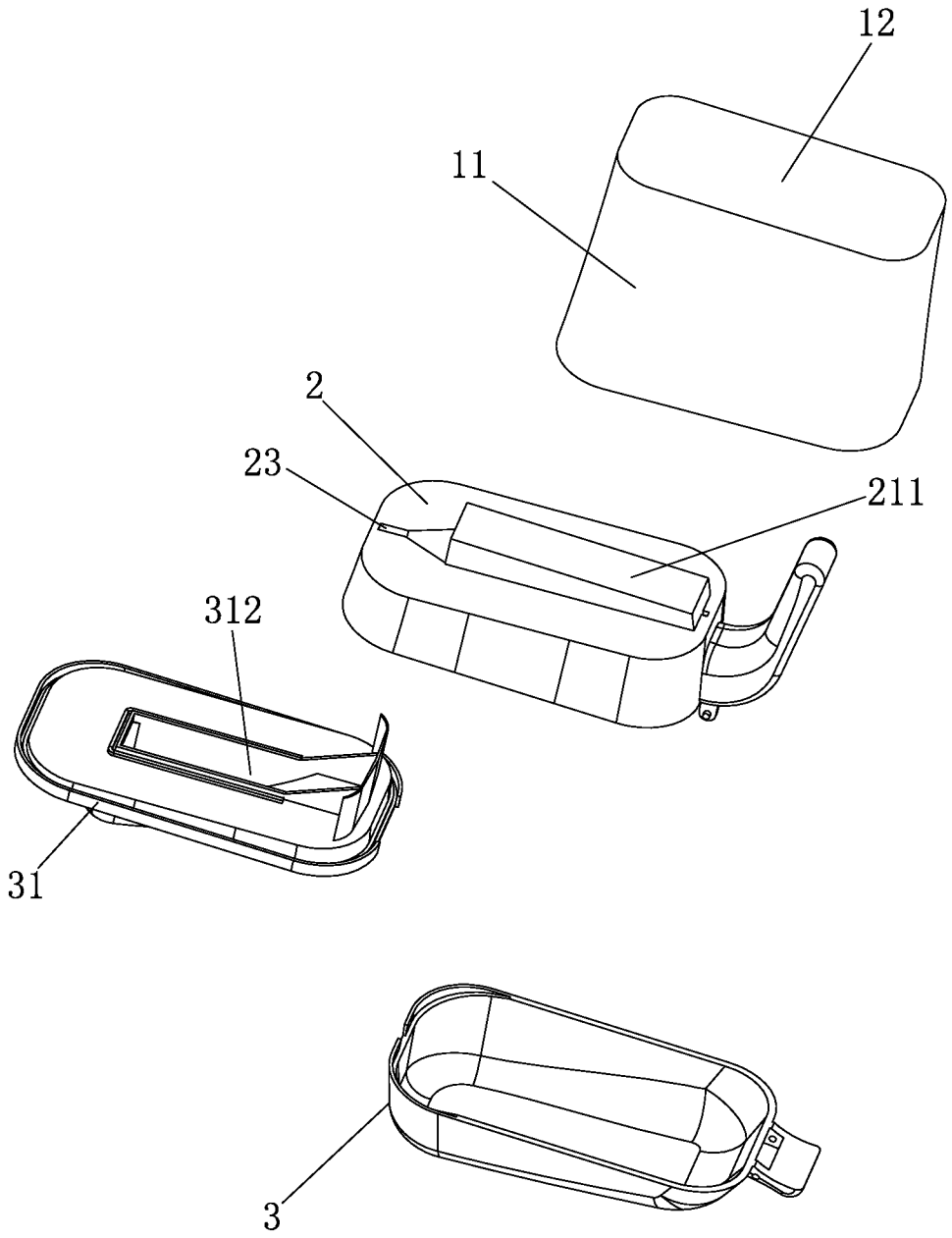
FIG. 9 is another exploded view of the bottle arrangement according to the fourth preferred embodiment of the present invention.
Figure 10:
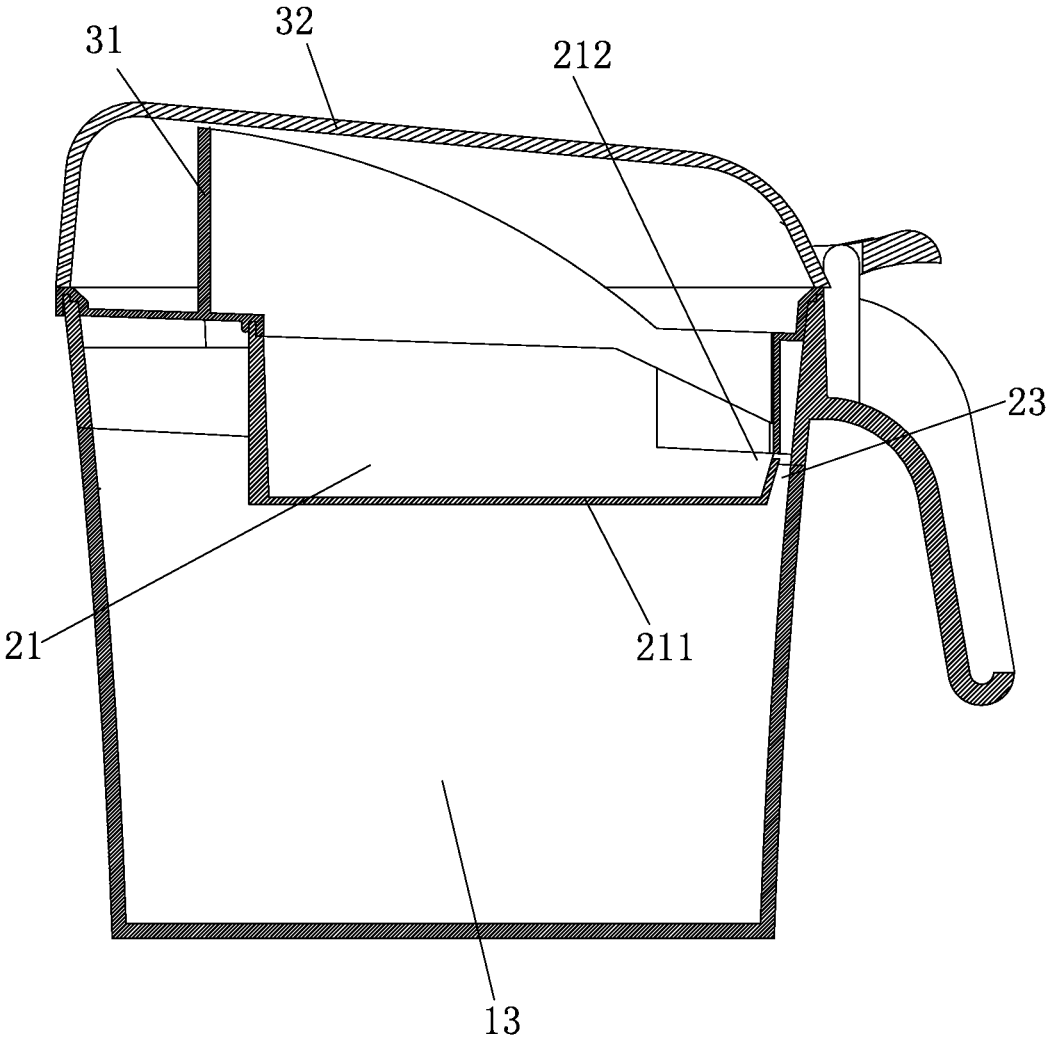
FIG. 10 is a sectional view of the bottle arrangement according to the fourth preferred embodiment of the present invention.
Figure 11:
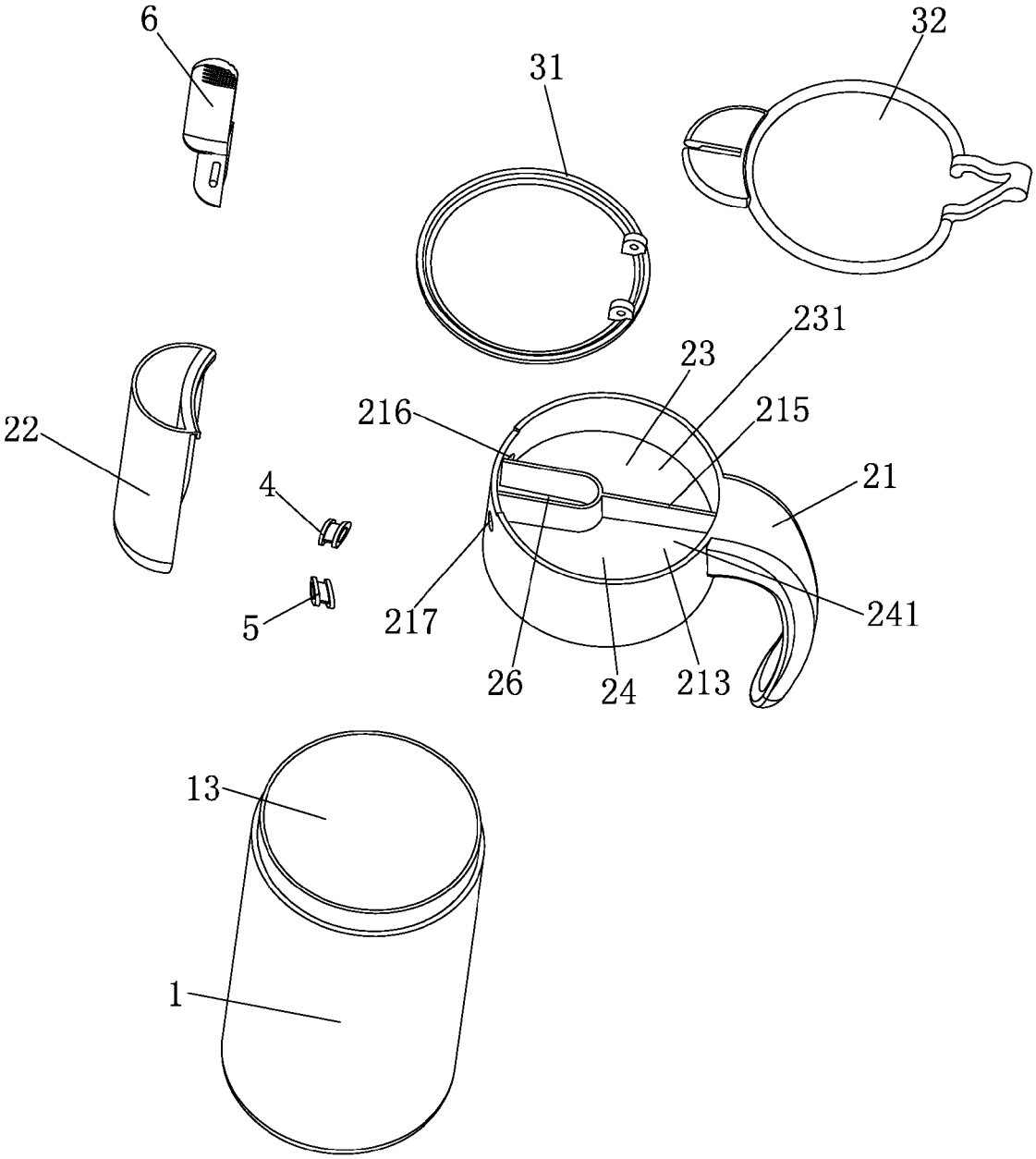
FIG. 11 is an exploded view of a bottle arrangement according to a fifth preferred embodiment of the present invention.
Figure 12:
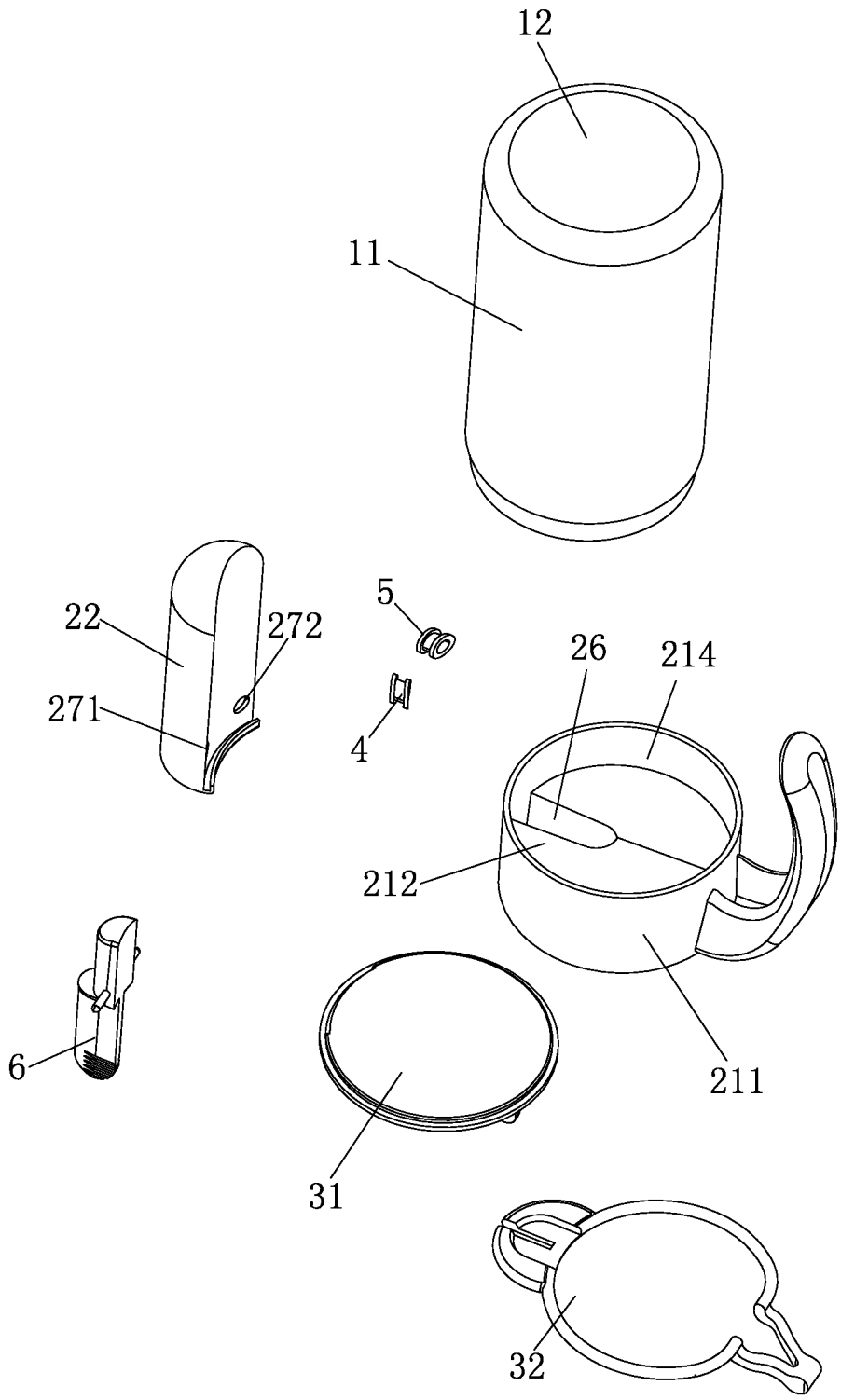
FIG. 12 is another exploded view of the bottle arrangement according to the fifth preferred embodiment of the present invention.
Figure 13:
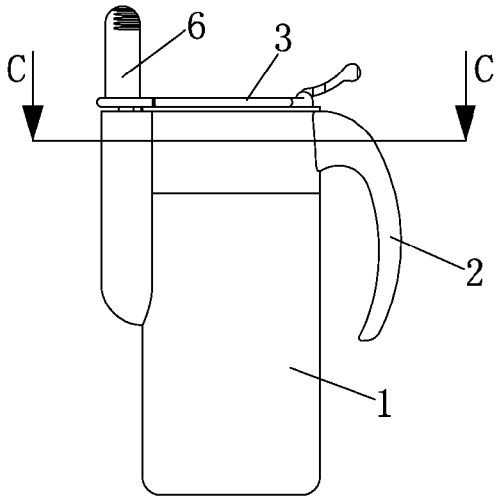
FIG. 13 a front view of the bottle arrangement according to the fifth preferred embodiment of the present invention.
Figure 14:
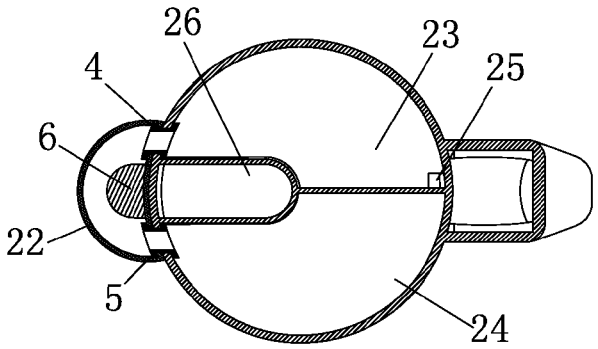
FIG. 14 is a sectional view along line C-C in FIG. 13.
Figure 15:
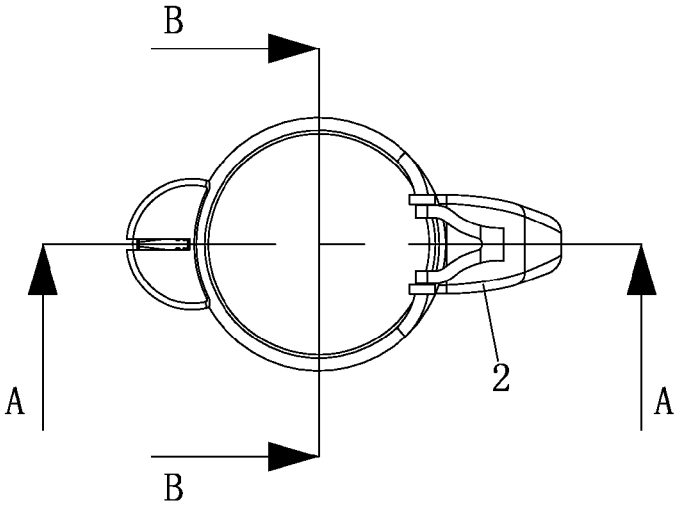
FIG. 15 is a top view of the bottle arrangement according to the fifth preferred embodiment of the present invention.
Figure 16:
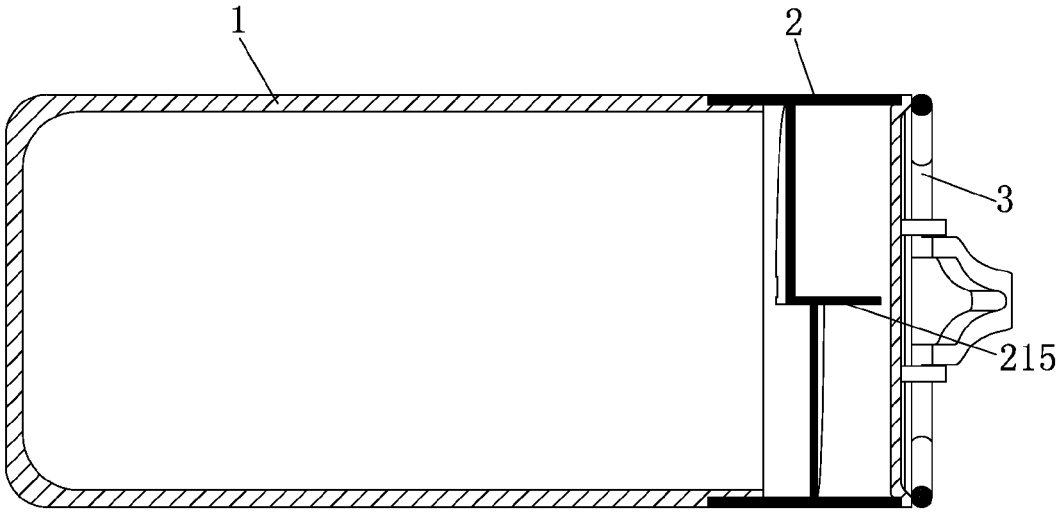
FIG. 16 is a sectional view of the bottle arrangement along line B-B of FIG. 15
Figure 17:
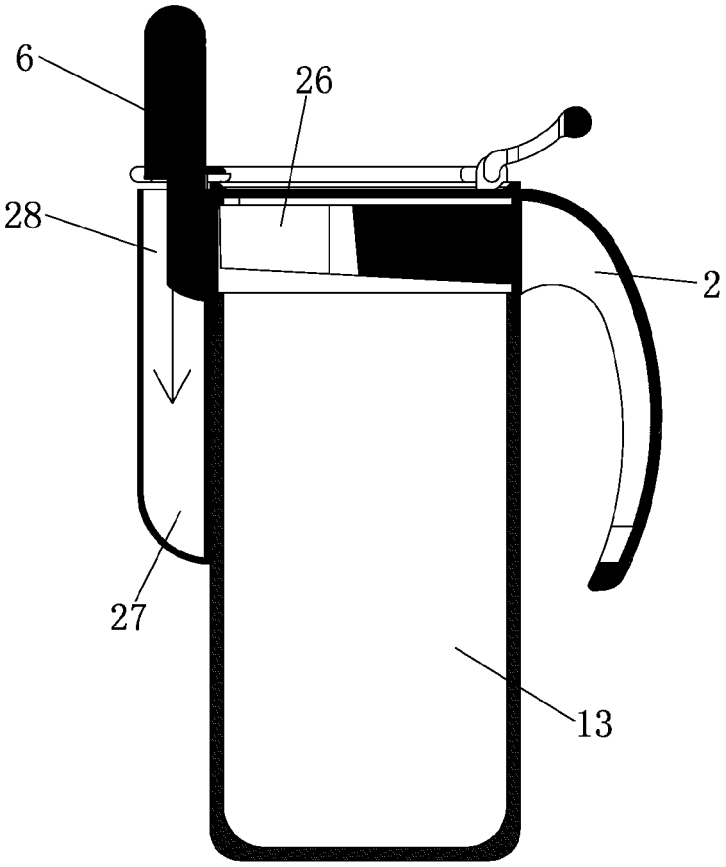
FIG. 17 is a sectional view of the bottle arrangement alone line A-A of FIG. 15.

Referring FIG. 8 to FIG. 10 of the drawings, a bottle arrangement according to this preferred embodiment comprises a bottle body 1, a measuring bucket 2, and an end cap 3. The bottle body 1 has a bottle wall 11 and a bottle base 12. A receiving cavity 13 is enclosed and defined by the bottle wall 11 and the bottle base 12.

The measuring bucket 2 has a measuring-dispensing chamber 21, inlet channel 22 and a backflow channel 23. The inlet channel 22 and the measuring-dispensing chamber 21 are partitioned from each other by a partition wall 24. The measuring-dispensing chamber 21 has a first chamber base 211 at a bottom side thereof, an inlet opening 213 at a top side thereof, and a backflow opening 212 below the inlet opening 213. The inlet opening 213 and the backflow opening 212 are both provided at positions higher than a position of the first chamber base 211. The inlet channel 22 has an inlet chamber 221 and a temporary storing chamber 222 which are communicated with each other. The inlet chamber 221 is arranged in an up-down penetration manner. The temporary chamber 222 has a second chamber base 251. The measuring-dispensing chamber 21 can be provided with two inlet openings 213 so that the fluid in the temporary storing chamber 222 can be divided into two streams of flow flowing into the measuring-dispensing chamber 21. The inlet chamber 22 and the backflow chamber 23 are respectively provided at two sides of the measuring-dispensing chamber 21.

The end cap 3 comprises a first end cap 31 and a second end cap 32. The first end cap 31 is capped on the measuring bucket 2 and has a penetrating discharge opening 312 which is communicated with the measuring-dispensing chamber. The first end cap 31 can be covered on the temporary storing chamber and the inlet chamber, so that unintentional discharge of the fluid when the bottle body is overturned is prevented.

In an initial state, the fluid is stored in the receiving chamber 13. When measuring and dispensing the fluid, the bottle body is overturned for a first time so that the bottle body and the measuring bucket are in an upside-down state, part of the fluid in the receiving chamber 13 flows into the temporary storing chamber 222 through the inlet chamber under the influence of gravity. And then, the bottle body is overturned for a second time so that the bottle body and the measuring bucket are in an upright state in which the fluid in the temporary storing chamber 22 flows along the second chamber base 251 and gets into the measuring-dispensing chamber 21 through the inlet opening 213. During this overturning process, the fluid overflowing from the backflow opening 212 flows back into the receiving chamber 13 of the bottle body through the backflow channel 23. And again the bottle body is overturned so that the bottle body and the measuring bucket are back to be in the upside-down state in which the fluid in the measuring-dispensing chamber 21 is discharged through the discharge channel 26 and the discharge opening 312 of the first end cap. At the same time, part of the fluid in the receiving chamber flows into the temporary storing chamber 222 through the inlet chamber 221.

Embodiment 5

Referring to FIG. 11 to FIG. 17 of the drawings, a bottle arrangement according to this preferred embodiment comprises a bottle body 1, a measuring bucket 2 and a top cap 3. The bottle body 1 has a bottle wall 11 and a bottle base 12. A receiving cavity 13 is enclosed and defined by the bottle wall 11 and the bottle base 12.

The measuring bucket 2 comprises a first measuring bucket 21 and a second measuring bucket 22. The first measuring bucket 21 comprises a ring-shaped encircling wall 211 and a middle wall 212 provided in the ring-shaped encircling wall 211. The ring-shaped encircling wall 211 is integrated with the middle wall 212 to form a one piece structure. The middle wall 212 has an upper surface and a lower surface. The upper surface and the encircling wall 211 define an upper chamber 213, the lower surface and the encircling wall 211 define a lower chamber 214. A partition wall 215 is protruded from the upper surface in such a manner that the upper chamber 213 is divided into a first backflow chamber 23 having a first chamber base 231 and a temporary storing chamber 24 having a second chamber base 241 which are not communicated with each other. The first backflow chamber 23 is communicated with the receiving chamber 13 through the second backflow chamber 25. The first measuring bucket 21 is further provided with an inlet chamber 26 which is extended from the inner surface to penetrate the partition wall 215. The encircling wall 211 has a first backflow opening 216 communicated with the first backflow chamber 23 and a first inlet opening 217 communicated with the temporary storing chamber 24. The second measuring bucket 22 has a measuring-dispensing chamber 27 and a discharge channel 28 provided above the measuring-dispensing chamber 27. The chamber wall of the measuring-dispensing chamber 27 is provided with a second inlet opening 272 and a second backflow opening 271. Two end portions of a backflow tube 4 are respectively inserted into the first backflow opening 216 and the second backflow opening 271, two end portions of a temporary storing tube 5 are respectively inserted into the first inlet opening 217 and the second inlet opening 272, so that the second measuring bucket is hung on at an outer side of the first measuring bucket 21. The second inlet opening 272 of the second measuring bucket is provided at a position above the second backflow opening 271 in the gravity direction. The first chamber base 231 can be embodied as a slanted surface that is capable of guiding the fluid to flow back into the second backflow chamber 25. The second chamber base 241 can be embodied as another slanted surface that is capable of guiding the fluid to flow into the measuring-dispensing chamber 27 having an inclining angle opposite an inclining angle of the first chamber base 231. The first backflow chamber 23 and the second backflow chamber 25 are communicated with each other to form a backflow passage communicating the second backflow opening 271 of the measuring-dispensing chamber to the receiving cavity 13 of the bottle body.

The top cap 3 comprises a first top cap 31 and a second top cap 32. The first top cap 31 is detachably mounted on a top side of the first measuring bucket 21 to close and seal the upper chamber 213 of the first measuring bucket 21. The second top cap 32 is pivotally connected to the first top cap 31 via a rotation axis so that the second top cap 32 can be moved between an open state and closed state.

In addition, the second measuring bucket 22 is further provided with an adjusting member 6 for adjusting a volume of the measuring-dispensing chamber 27. When the adjusting member 6 is lifted up, the actual volume of the measuring-dispensing chamber 27 is increased; when the adjusting member 6 is pressed downward, the actual volume of the measuring-dispensing chamber 27 is decreased. The volume of the measuring-dispensing chamber 27 is not changed, but by controlling the inserting depth of the adjusting member in the measuring-dispensing chamber, the actual volume available for receiving fluid in the measuring-dispensing chamber can be altered.

When in use, the bottle body is overturned for several times, so that part of the fluid in receiving chamber flows into the temporary storing chamber 24 through the inlet chamber 26 of the first measuring bucket 21, and then the fluid in the temporary storing chamber 24 flows into the measuring-dispensing chamber 27 of the second measuring bucket 22 through the temporary storing tube 5. The fluid climbing over the second backflow opening 271 from the measuring-dispensing chamber 27 can flow back into the receiving cavity 13 through the backflow tube 4 and the backflow chamber 23.

In this preferred embodiment, the temporary storing chamber and the measuring-dispensing chamber both have a chamber base and a chamber wall, while the inlet channel and the backflow tube 4 are penetrating structure. The second backflow opening of measuring-dispensing chamber and the backflow tube 4 are provided at higher positions of the measuring bucket, so that when the measuring bucket is in the upside-down state, the fluid in the receiving chamber cannot flow into the measuring-dispensing chamber.

Embodiment 6

Figure 18:
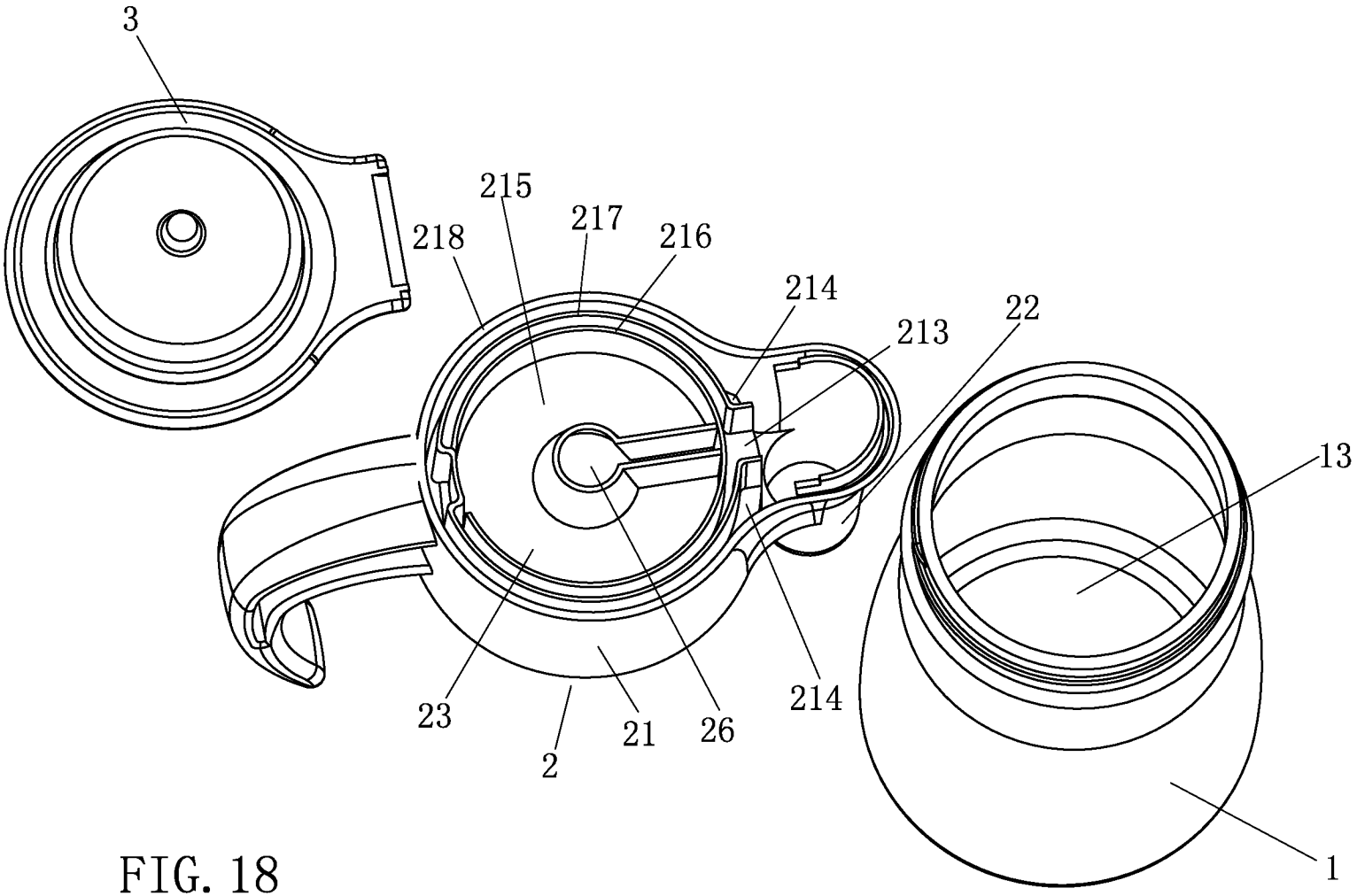
FIG. 18 is an exploded view of a measuring and dispensing device of a bottle arrangement according to a six preferred embodiment of the present invention.
Figure 19:
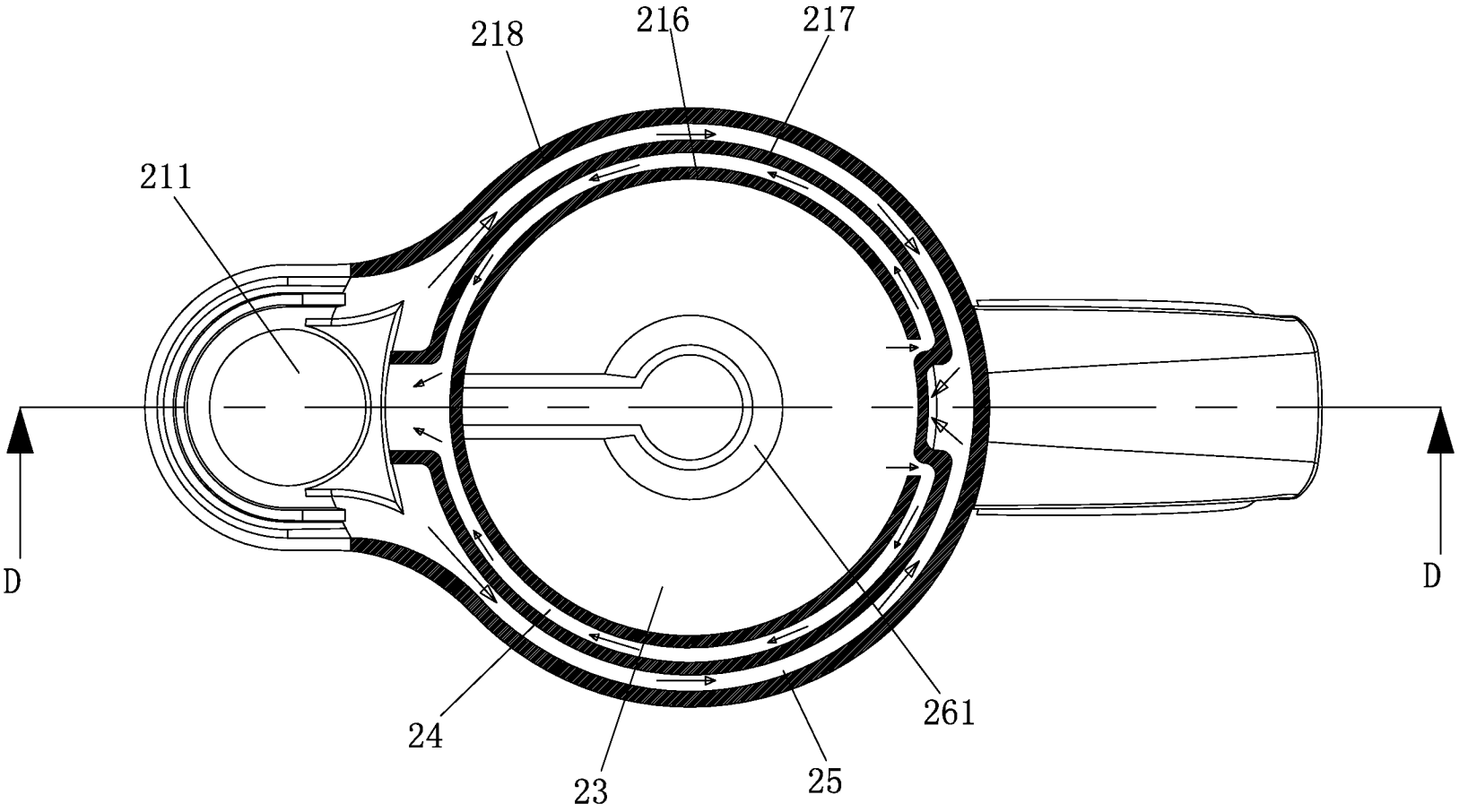
FIG. 19 is a sectional view of the bottle arrangement (without a top cap) according to the sixth preferred embodiment of the present invention.
Figure 20:
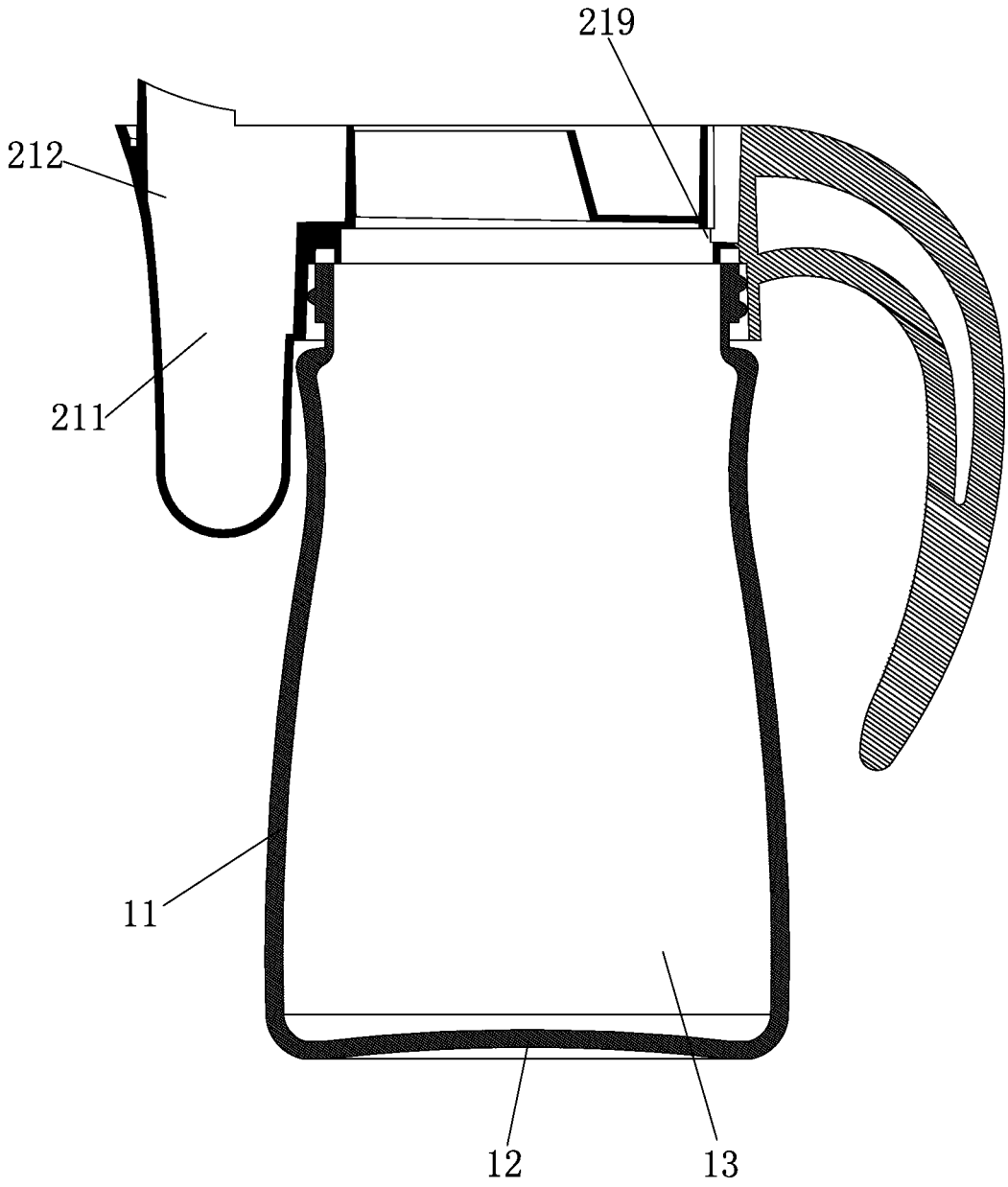
FIG. 20 is a sectional view of the bottle arrangement along line D-D of FIG. 19.
Figure 21:
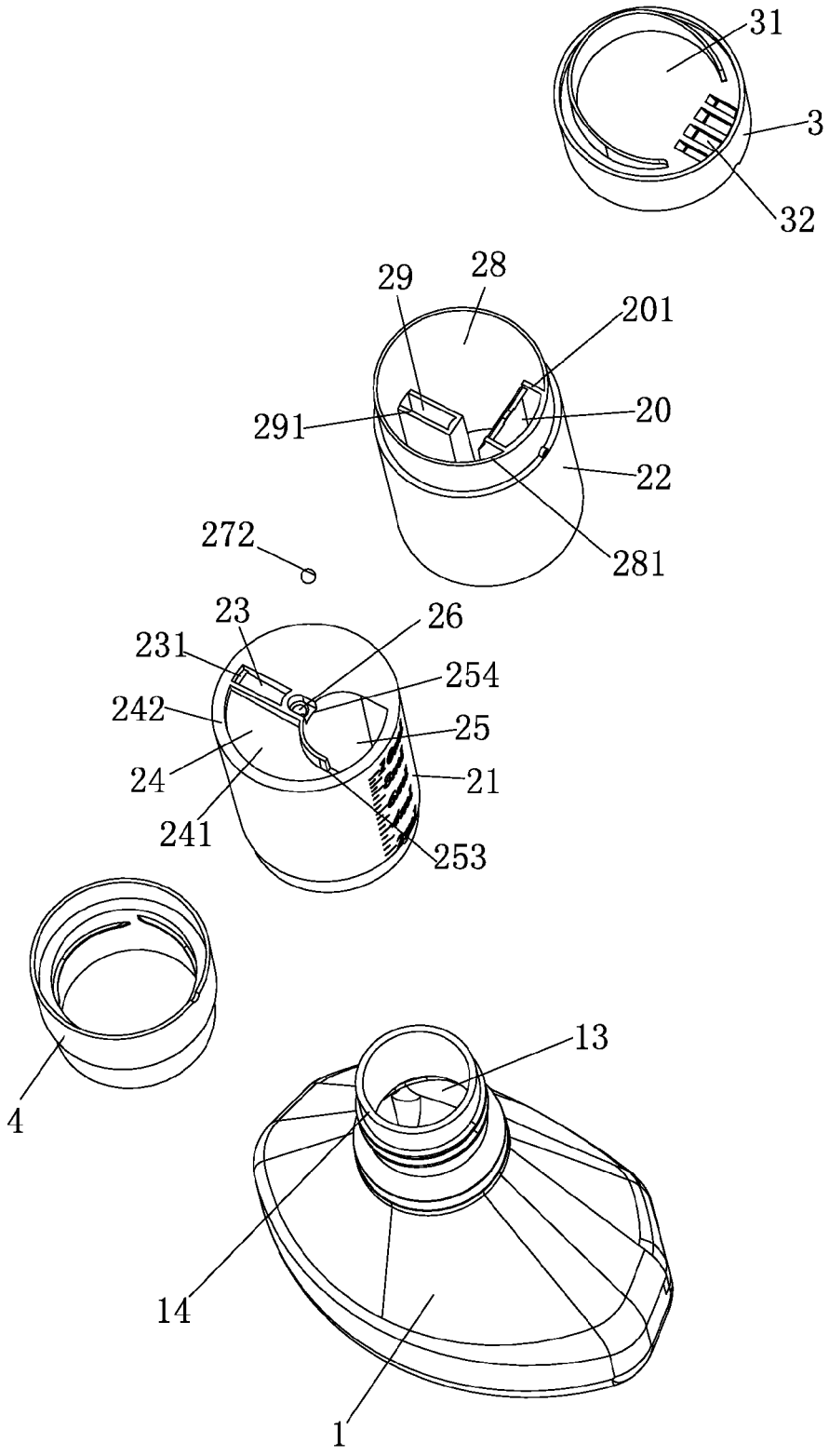
FIG. 21 is an exploded view of a bottle arrangement according to a seventh preferred embodiment of the present invention.
Figure 22:
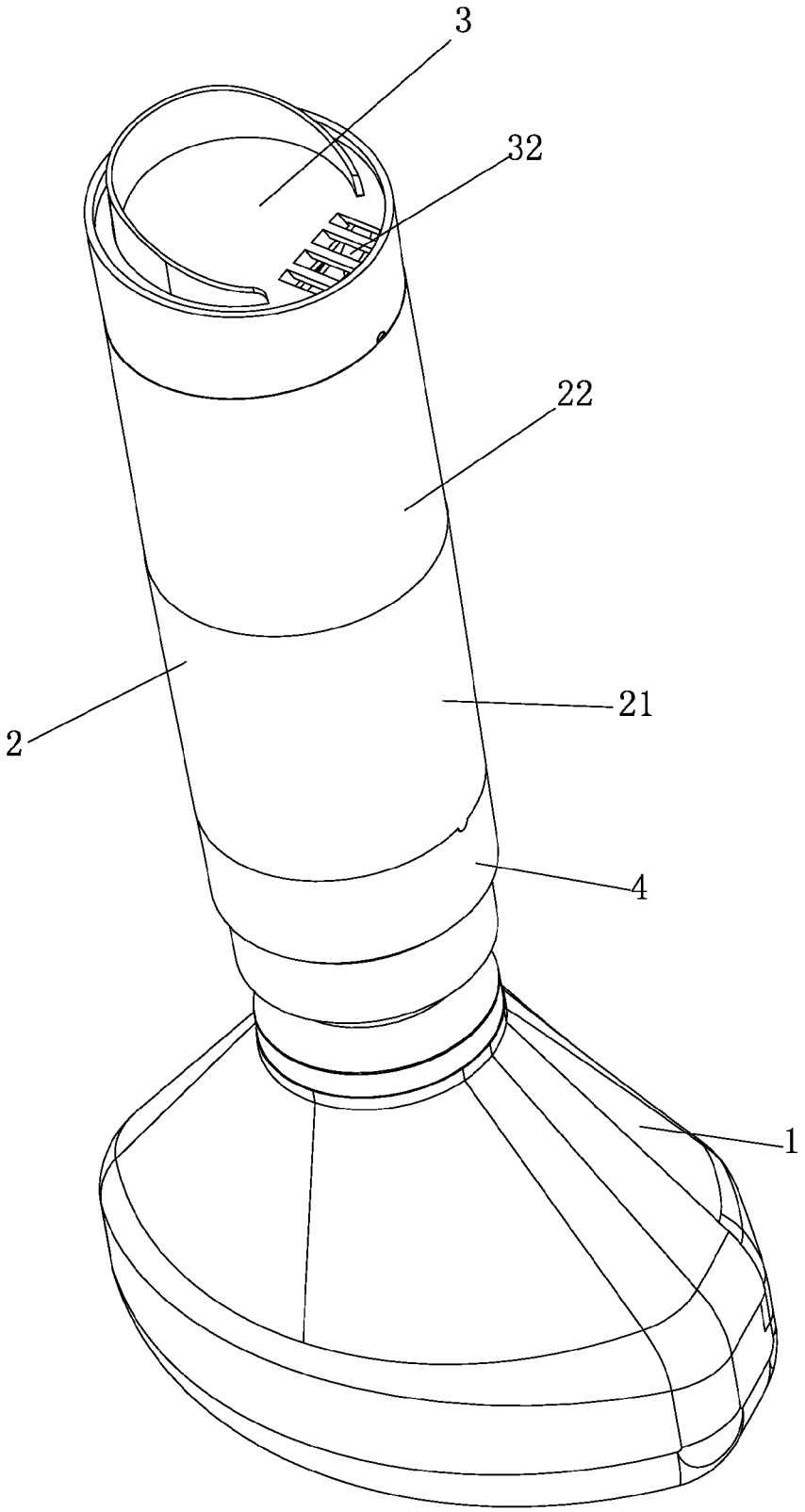
FIG. 22 is a perspective view of the bottle arrangement according to above seventh preferred embodiment of the present invention.
Figure 23:
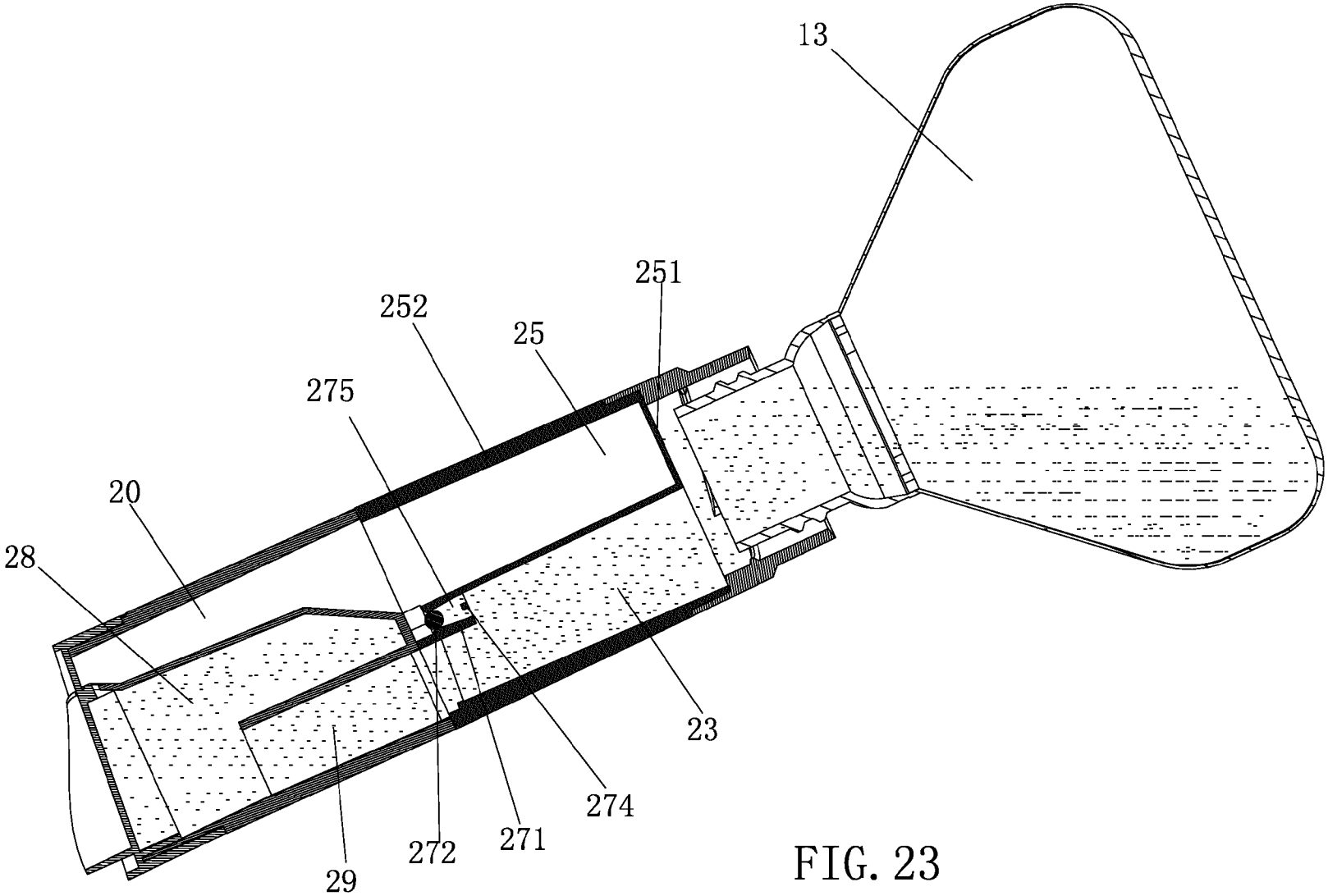
FIG. 23 is a sectional view illustrating the bottle arrangement being overturned for a first time according to the seventh preferred embodiment of the present invention.
Figure 24:
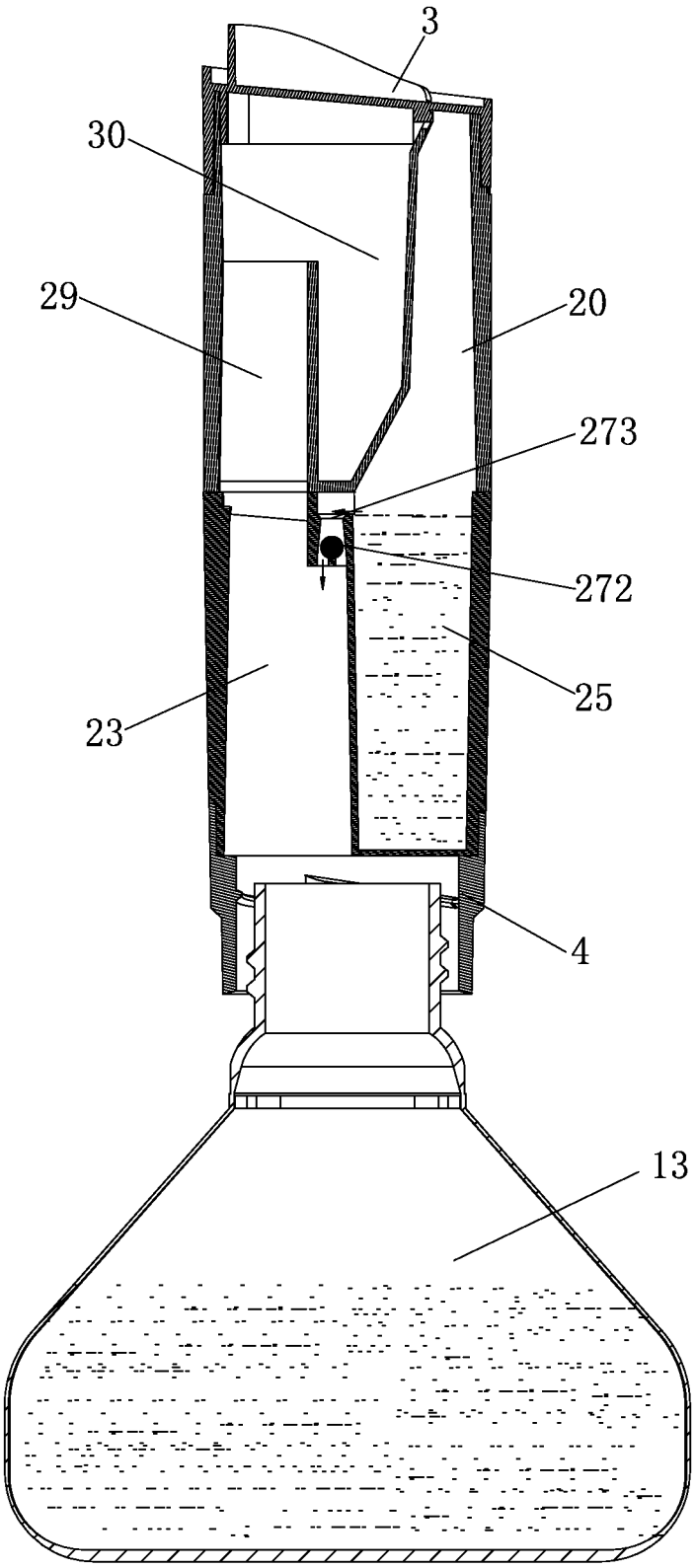
FIG. 24 is a sectional view illustrating the bottle arrangement being overturned for a second time according to the seventh preferred embodiment of the present invention.
Figure 25:
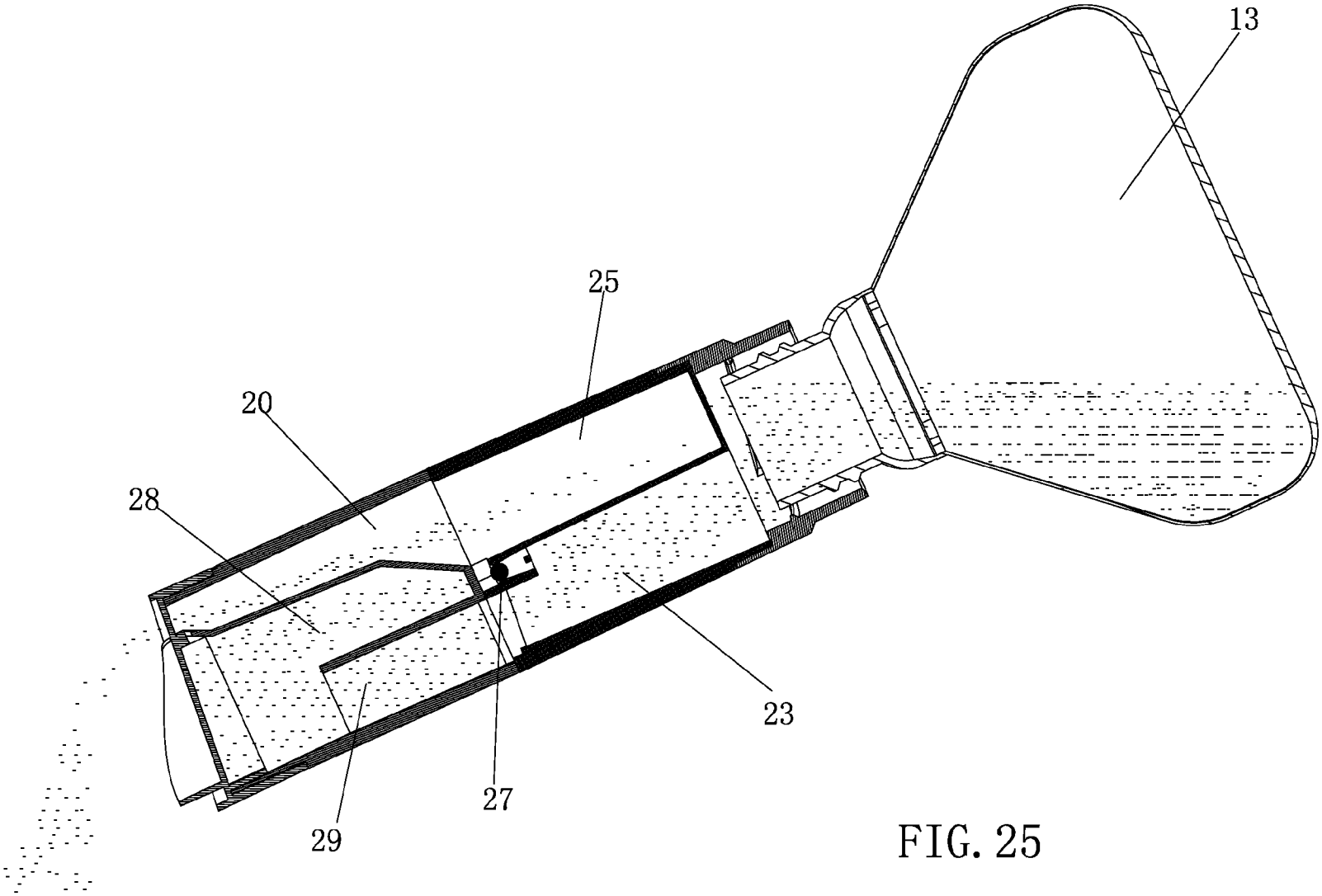
FIG. 25 is a sectional view illustrating the bottle arrangement being overturned for a third time according to the seventh preferred embodiment of the present invention.
Figure 26:
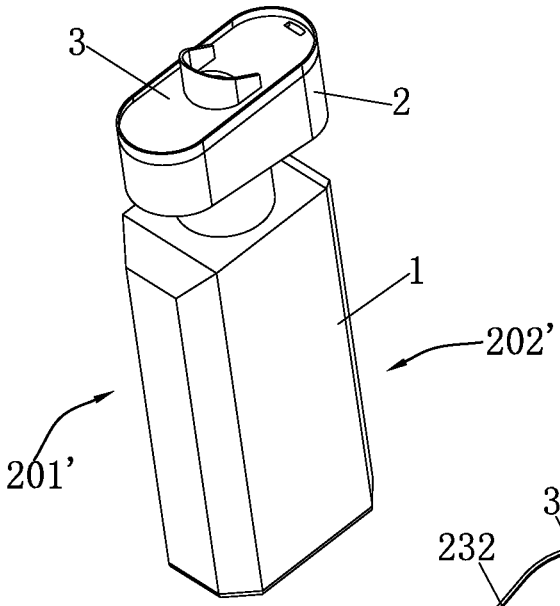
FIG. 26 is a perspective view of a bottle arrangement according to an eighth preferred embodiment of the present invention.

Referring to FIG. 18 to FIG. 20 of the drawings, the bottle arrangement according to this preferred embodiment comprises a bottle body and a measuring arrangement provided at a bottle opening of the bottle body.

The bottle body comprises a bottle wall 11 and a bottle base 12. A receiving cavity 13 is enclosed and defined by the bottle wall 11 and the bottle base 12.

The measuring arrangement comprises a measuring bucket 2 and a top cap 3. The measuring bucket 2 comprises a first measuring bucket 21 and a second measuring bucket 22 which are integrated with each other. The first measuring bucket 21 has a measuring-dispensing chamber 211 and a discharge channel 212 provided above the measuring-dispensing chamber 211. A chamber wall around the measuring-dispensing chamber 211 has an inlet opening 213 and a backflow opening 214. The first measuring bucket 21, which can be mounted on the bottle body 1 by screw connection, comprises a first base panel 215 and a ring-shaped first enclosing panel 216, a ring-shaped second enclosing panel 217 and a ring-shaped third enclosing panel 218 provided on the first base panel 215 in an inside to outside manner. The base panel 215 and the first enclosing panel 216 define a temporary storing chamber 23 which is communicated with the receiving chamber 13. The first enclosing panel 216, the second enclosing panel 217, and the first base panel 215 define a ring-shaped communicating channel 24 which is respectively communicated with the temporary storing chamber 23 and the inlet opening 213 of the measuring-dispensing chamber 211 at two ends thereof. The second enclosing panel 217, the first base panel 215, and the third enclosing panel 218 define a ring-shaped backflow channel 25 which has a communicating hole 219 provided in the first base panel 215. The backflow channel 25 has an end communicated with the receiving chamber 13 through the communicating hole 219 and another end communicated with the backflow opening 214 of the measuring-dispensing chamber 211. The backflow opening 214 and the inlet opening 213 of the measuring-dispensing chamber 211 are partitioned from each other, and in the gravity direction, a position of the inlet opening 213 is higher than a position of the backflow opening 214. The first base panel is constructed to be the chamber base of the temporary storing chamber. The second measuring bucket further has an inlet chamber 26 arranged in an up-down penetration manner which communicates the receiving chamber 13 to the temporary storing chamber 23. The inlet chamber 26 is defined by a chamber wall 261 which is provided at a position higher than a position of the first base panel 215.

The top cap 3 is detachably mounted on the measuring bucket 2.

When measuring and dispensing the fluid, the bottle body is overturned several times so that the fluid in the receiving chamber firstly flows into the temporary storing chamber 23 of the first measuring bucket, and then the fluid in the temporary storing chamber flows into the measuring-dispensing chamber 211 through the communicating channel 24, the fluid in the measuring-dispensing chamber 211 is finally discharged through the discharge channel 212. When the measuring-dispensing chamber 211 is full of the fluid, the fluid continually flowing into the measuring-dispensing chamber 211 is guided to flow back into the receiving chamber 13 through the backflow opening 214 and the backflow channel 25.

Embodiment 7

Referring to FIG. 22 to FIG. 25 of the drawings, a bottle arrangement according to this preferred embodiment comprises a bottle body 1, a measuring bucket 2 and a top cap 3.

The bottle body has a receiving chamber 13 which has a bottle base 12 at a bottom side thereof and a bottle opening 14 at a top side thereof.

The measuring bucket 2 comprises a first measuring bucket 21 and a second measuring bucket 22. The first measuring bucket 21 has a first inlet channel 23, a first lower compartment 24, and a second compartment 25. The first inlet channel 23, which is defined by an inlet chamber wall 231 having a ring-shaped cross section, is provided in an up-down penetration manner. The first lower compartment 24 has a first lower compartment base 241 which can be embodied as a slanted surface capable of guiding the fluid to flow under the influence of gravity, and a first lower compartment wall 242 having a ring-shaped cross section. The second compartment 25 has a second compartment base 251 and a second compartment wall 252 having an inlet opening 253 and a backflow opening 254. The inlet opening 253 is provided at a lower position of the second compartment base. A position of the inlet opening is not lower than a position of the backflow opening. Preferably, the position of the inlet opening is higher than the position of the backflow opening. A backflow channel 26, which communicates the backflow opening 254 to the receiving chamber 13, is provided with a one-way valve 27 controlling the open and close of the backflow channel. In a preferred embodiment, the one-way valve 27 comprises a valve body 271 and a valve core 272. The valve body 271 has a tapered valve chamber 275 having an inner diameter at a lower portion is smaller than an inner diameter at a higher portion. The valve core 272 is embodies as a ball. The valve chamber 275 defines a valve opening 273 at a minimized inner diameter thereof. An outer diameter of the valve core 272 is large than the inner diameter of the valve opening 273 but is smaller than the largest inner diameter of the valve chamber 271. A blocking member 274 is provided at the largest inner diameter of the valve chamber 275 for preventing the valve core to fall off. The positions of up and down herein are determined with respect to the gravity direction.

The second measuring bucket 22 has an upper compartment 28, a second inlet channel 29, and a discharge channel 20. The second upper compartment 28 has a second upper compartment wall 281 having a ring-shaped cross section and is arranged in an up-down penetration manner. The second inlet channel 29 is defined by a third compartment wall 291 having a ring-shaped cross section and is arranged in an up-down penetration manner. The discharge channel 20 is defined by a fourth compartment wall 201 having a ring-shaped cross section and is arranged in an up-down penetration manner.

The top cap 3 has a sealing portion 31 which can closed and seal the top side of the second upper wall, and a discharge opening 32 communicating the discharge channel to outside.

During an assembly process, a connecting ring 4 is coupled with the bottle opening 14 of the bottle body by screw connection. The first measuring bucket 21 is sealedly mounted to the connecting ring 4, the mounting method can be glue bonding connection, screw connection, form-fitting connection, plug/bush connection or other mounting method. The second measuring bucket 22 is then mounted to the first measuring bucket by the above mentioned methods. The top cap is finally capped on the second measuring bucket 22. After assembling, the first lower compartment 24 and the first upper compartment 28 form a first compartment 30. The first lower compartment base 241 is constructed to be a first compartment base of the first compartment 30, the first lower compartment wall and the first upper compartment wall are sealed and coupled with each other to form a first compartment wall of the first compartment. The discharge channel and the second compartment are sealed and coupled with each other. The first inlet channel 23 and the second inlet channel 29 are sealed and coupled with each other to form an inlet passage.

In an initial state, the fluid is stored in the receiving chamber 13 and the bottle body is in an upright state. When measuring and dispensing the fluid, the bottle arrangement is overturned for a first time so that the measuring bucket and the bottle body are in an upside-down state. During the overturning process, under the influence of gravity, the fluid in the receiving chamber 13 passes through the first inlet channel 23 and the second inlet channel 29 to flow into the first compartment 30, the valve core 272 closes the valve opening (i.e. the one-way valve is closed), so that the fluid in the receiving chamber cannot flow into the second compartment 25. And then, the bottle arrangement is overturned again so that the measuring bucket and the bottle body return to the upright state, during this overturning process, under the influence of gravity, the fluid in the first compartment flows into the second compartment 25 through the inlet opening, the valve core moves away from the valve opening (i.e. the one-way valve is opened) to communicate the backflow channel with the receiving chamber so that the fluid climbs over the backflow opening is guided to flow into the receiving chamber through the backflow channel. Finally, the bottle arrangement is overturned for a third time so that the measuring bucket is overturned to be in the upside-down state, during this process, the valve core closes the valve opening, so that the fluid in the second compartment is discharged through the discharge channel and the discharge opening, and the fluid in the receiving chamber refills the second compartment.

Embodiment 8

Referring to FIG. 26 to FIG. 33 of the drawings, a bottle arrangement according to this preferred embodiment comprises a bottle body 1, a measuring bucket 2 and a top cap 3. The bottle body has a receiving chamber 13 which has a bottle base 12 at a bottom side thereof and a bottle opening 14 at a top side thereof The measuring bucket 2 is detachably mounted at the bottle opening 14. The measuring bucket 2 has an inlet channel 21, a first compartment 22 having a first compartment base 221, a second compartment 23 having a second compartment base 231, a backflow channel 24, and a discharge channel 25. The inlet channel 21 communicates the receiving chamber 13 to the first compartment 22. The first compartment base 221 is embodies as a slanted surface which is capable of guiding the fluid to flow into the second compartment 23 under the influence of gravity. The second compartment 23 has an inlet opening 233. The backflow channel 24 is communicated with inlet opening 233 and the receiving chamber 13. The discharge channel 25 is communicated with the second compartment 23. The top cap 3 has a sealing portion 31 for closing and sealing the top opening of the first compartment, and a flow guiding opening 32 communicated with the discharge channel. The backflow channel 24 and the inlet channel 21 are respectively provided at two sides of the second compartment 23. When the measuring bucket is in an upside-down state, the integral backflow channel 24 is provided above the fluid in the receiving chamber 13, so that the fluid in the receiving chamber 13 cannot flow into the second compartment 23. The measuring bucket can further have a communicating channel 26 for communicating the first compartment 22 to the inlet opening 233 of the second compartment 23. When measuring and dispensing the fluid, a flow route of the fluid is shown by arrows in FIG. 32 of the drawings. In addition, the compartment base of the second compartment is movable so that a volume of the second compartment can be changed.

An overturning device for measuring and dispensing fluid comprises a measuring bucket provided above a bottle body, the measuring bucket has a measuring-dispensing chamber, discharge channel, an inlet channel for guiding the fluid in the bottle body to flow into the measuring-dispensing chamber, and a backflow channel for guiding the fluid in the measuring-dispensing chamber to flow back into the bottle body or the inlet channel. The measuring-dispensing chamber has a chamber base at a bottom side thereof and a backflow determining a volume of the measuring-dispensing chamber. The inlet channel is communicated with the measuring-dispensing chamber. The discharge channel communicates the measuring-dispensing chamber to outside. The backflow channel is communicated with the backflow opening. The backflow channel, the inlet channel are partitioned from the discharge channel, so that during the filling, back flowing, or the discharging process, the fluid will be not easy to mistakenly flow into other channels. The discharge channel is provided above the measuring-dispensing chamber. The storing chamber is used to storing the fluid. The measuring-dispensing chamber, which is used to precisely measure and dispense the fluid, has a predetermined volume which has relation with a position of the backflow opening. The inlet channel defines a route of the fluid flowing from the receiving chamber to the measuring-dispensing chamber. The backflow channel defines a route of the fluid flowing from the measuring-dispensing chamber to the receiving chamber. The discharge channel is used to communicate the measuring-dispensing chamber to outside. The inlet channel communicating the measuring-dispensing chamber to outside can be embodied as any channel including the inlet channel, inlet chamber, temporary storing chamber, and communicating channel in the above mentioned preferred embodiments.

The measuring bucket has a first state in which the fluid in the first compartment (temporary storing chamber) is capable of flowing into the second compartment, and a second state in which the fluid in the first compartment cannot flow into the second compartment. When in the first state, the measuring bucket is in an upright position which can be in a direction of vertically facing upward, levelly facing upward or inclinedly facing upward. When in the second state, the measuring bucket is in an upside-down state in which the measuring bucket can be inclinedly facing downward. In order to facilitating the fluid in the first compartment to flow into the second compartment, the first compartment base can have a guiding surface which can be embodied as a single guiding surface or a surface formed by a plurality of adjoining slanted surfaces, or other surface which is capable of guiding the flow of the fluid.

In the measuring bucket, a one-way valve is provided in the backflow channel in order to prevent the fluid in the receiving cavity from flowing into the second compartment (measuring-dispensing chamber) in the first state. Alternatively, in the first state, the backflow opening and the backflow channel are provided above the fluid in the receiving chamber.

In the measuring bucket, the first compartment and the respectively second compartment both have a closed compartment base and a top opening. In other words, both the first compartment and the respectively second compartment are defined by a compartment base and a compartment wall having a ring-shaped cross section. The cross section can be constructed to be in annular ring shape, triangle ring shape, oval ring shape, runway ring shape, square ring shape, other regular or irregular ring shape. The ring shape can be formed as a closed ring shape or non-closed ring shape. The compartment wall also can be formed in other shapes. The top opening of the first compartment can be closed and sealed by the top cap. The inlet channel, which is arranged in an up-down penetration manner, can be deemed to be defined by the compartment wall having a ring-shaped cross section. The backflow channel, which is defined by the chamber base and the chamber wall, has a predetermined volume and provides functions of both backflow and temporary storage for the fluid. The backflow channel also can be constructed to be a penetration structure which does not provide a temporary storage effect. The discharge channel can be formed in a penetration structure. The first compartment can be directly communicated with the inlet opening of the second compartment. Of course, the first compartment can be communicated with the inlet opening of the second compartment through the communicating channel. The compartment bases and the compartment walls of the measuring bucket can be individually provided and forms an one piece structure by means of the measuring bucket body. The compartment bases and the compartment walls also can be shared or partially shared. For example, the first compartment and the second compartment share part of the compartment walls. Because the first compartment has a first compartment base, a temporary storage of the fluid can be provided. Because the second compartment has a second compartment base, a precise measure and dispense of the fluid can be achieved.

In the measuring bucket, the first compartment base of the first compartment can be provided above the second compartment base of the second compartment. The first compartment can be totally or partially provided above the second compartment. The inlet opening can be provided above the backflow opening.

In the measuring bucket, the backflow channel can be directly communicated with the receiving chamber of the bottle body, so that the overflowing fluid from the backflow opening of the second compartment will directly flow back into the receiving chamber. The backflow channel also can be directly communicated with the first compartment (temporary storing chamber), so that the overflowing fluid from the backflow opening will directly flow back into the first compartment.

The overturning device for measuring and dispensing fluid can be cooperated and used together with bottle bodies of varied specifications, or alternatively mounted with the bottle body to form a bottle arrangement.

In the bottle arrangement, the measuring-dispensing chamber, the receiving chamber and other channels can be formed by means of a plurality of partition panels in the bottle body, or alternatively individually provided in the measuring bucket. The measuring bucket is cooperated with the bottle body to achieve the measure and dispense of the fluid. The measuring bucket can be a single component or assembled by two or more components.

To further clarify the bottle arrangement according to the eighth preferred embodiment of the present invention, the bottle arrangement comprises a bottle body 1, and a measuring bucket 2 provided on and engaged with a top side of the bottle body 1. The measuring bucket 2 has an overturning side 201' and an opposed backflow side 202' formed along a longitudinal direction of the measuring bucket 2.

The bottle body 1 has a receiving chamber 13 for storing a predetermined amount of liquid, a bottle base 12 formed as a bottom panel of the bottle body 1, and a bottle opening 14 formed at a top portion of the bottle body 1. The bottle opening 14 communicates the receiving chamber 13 with an exterior of the bottle body 1. An engagement rim 141' upwardly protrudes from the bottle body 1 so that the bottle opening 14 is formed within the engagement rim 141'.

Figure 27:
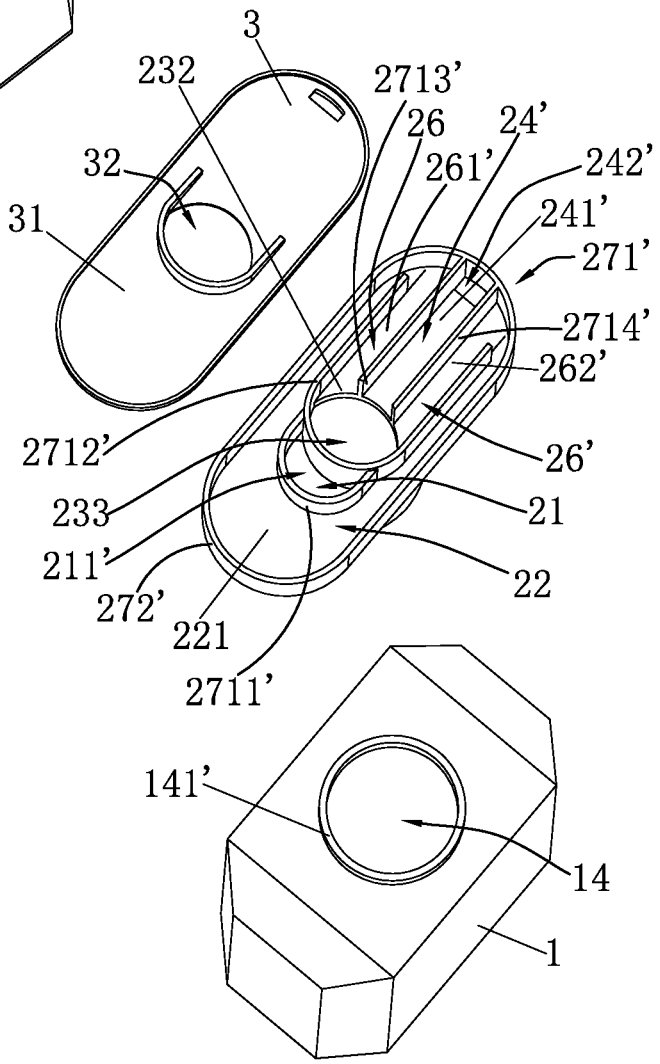
FIG. 27 is an exploded view of a bottle arrangement according to an eighth preferred embodiment of the present invention.

The measuring bucket 2 is detachably mounted at the bottle opening 14. More specifically, the measuring bucket 2 comprises a guiding base assembly 271', and a surrounding rim 272' circumferentially and upwardly extended from and along a side edge of the guiding base assembly 271' to define a bucket cavity 273' in a space confined by the guiding base assembly 271', the surrounding rim 272', and a top cap 3. As shown in FIG. 27 of the drawings, the top cap 3 has a flow guiding opening 32 communicating the bucket cavity 273' with an exterior of the measuring bucket 2.

Figure 28:
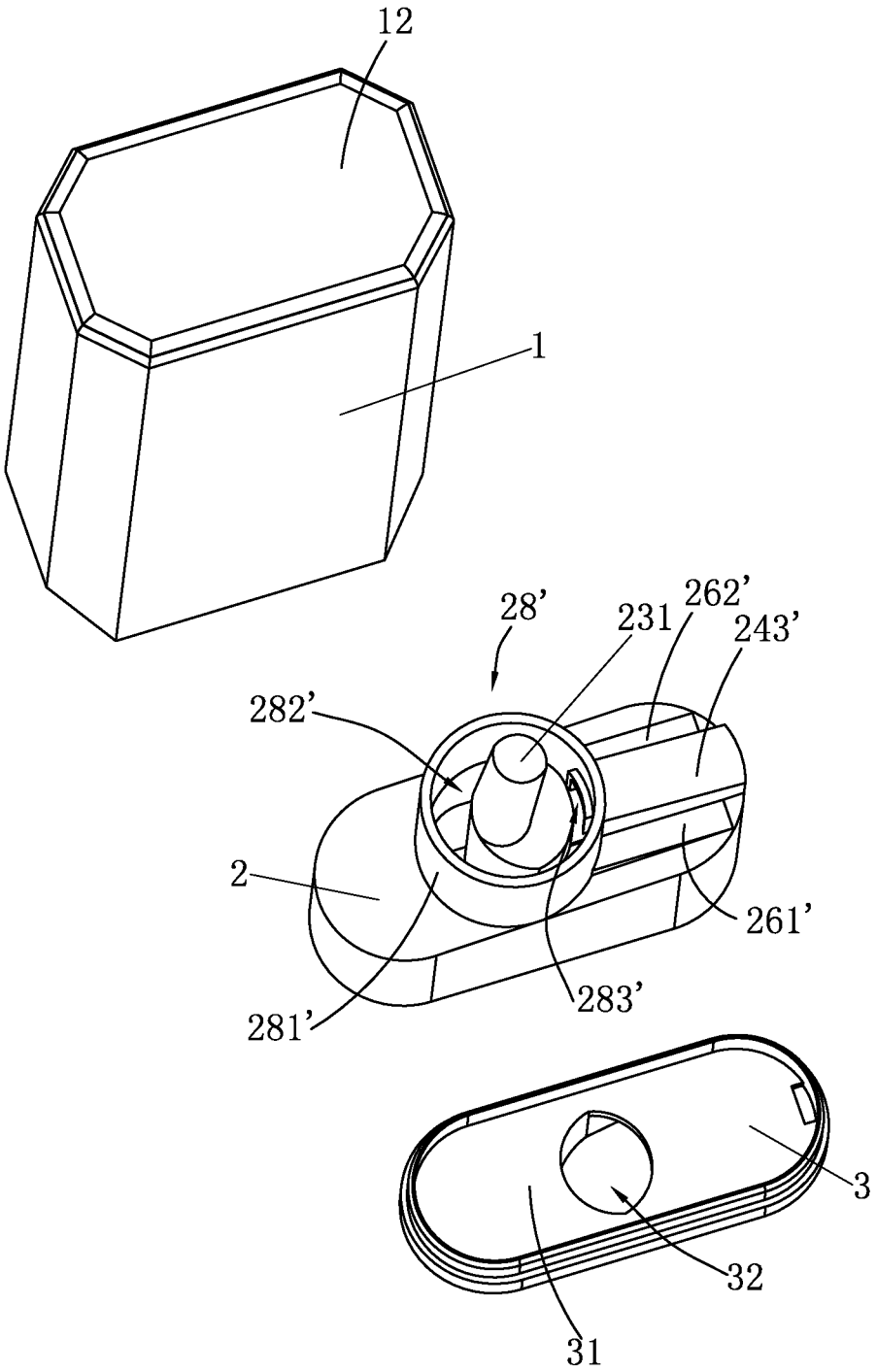
FIG. 28 is another exploded view of the bottle arrangement according to the eighth preferred embodiment of the present invention.

The measuring bucket 2 further comprises a lower engagement member 28' downwardly extended from a bottom side of the guiding base assembly 271'. As shown in FIG. 28 of the drawings, the lower engagement member 28' has an annular structure having an outer boundary 281' and a central cavity 282' bounded by the outer boundary 281'. An inner diameter of the outer boundary 281' is substantially the same as an outer diameter of the engagement rim 141' of the bottle body 1. The lower engagement member 28' is arranged to detachably engage with the engagement rim 141' so as to attach the measuring bucket 2 onto the bottle body 1.

The guiding base assembly 271' comprises a first compartment base 221, a first channel base 261', a second channel base 262', and a backflow channel base 241'. Each of the first compartment base 221, the first channel base 261', and second channel base 262', and the backflow channel base 241' has a predetermined slope such that liquid flowing on the first compartment base 221, the first channel base 261', the second channel base 262' and the backflow channel base 241' is guided by natural gravitational force to flow in a descending direction (i.e. from a vertically higher position to a vertically lower position).

On the other hand, the measuring bucket 2 further comprises first through fourth partitioning walls 2711', 2712', 2713', 2714' upwardly extended from the guiding base assembly 271' to divide the measuring bucket 2 into a first compartment 22, a first communicating channel 26, a second communicating channel 26', and a backflow channel 24'.

The first communicating channel 26 is formed in the space bounded by the second partitioning wall 2712', the third partitioning wall 2713', and the first channel base 261. The second communicating channel 26' is formed in the space bounded by the second partitioning wall 2712', the fourth partitioning wall 2714', and the second channel base 262'. The backflow channel 24 is formed in the space bounded by the third partitioning wall 2713', the fourth partitioning wall 2714', and the backflow channel base 241'. The top cap 3 is provided for preventing liquid from spilling out of the bucket cavity 273'.

Figure 33:
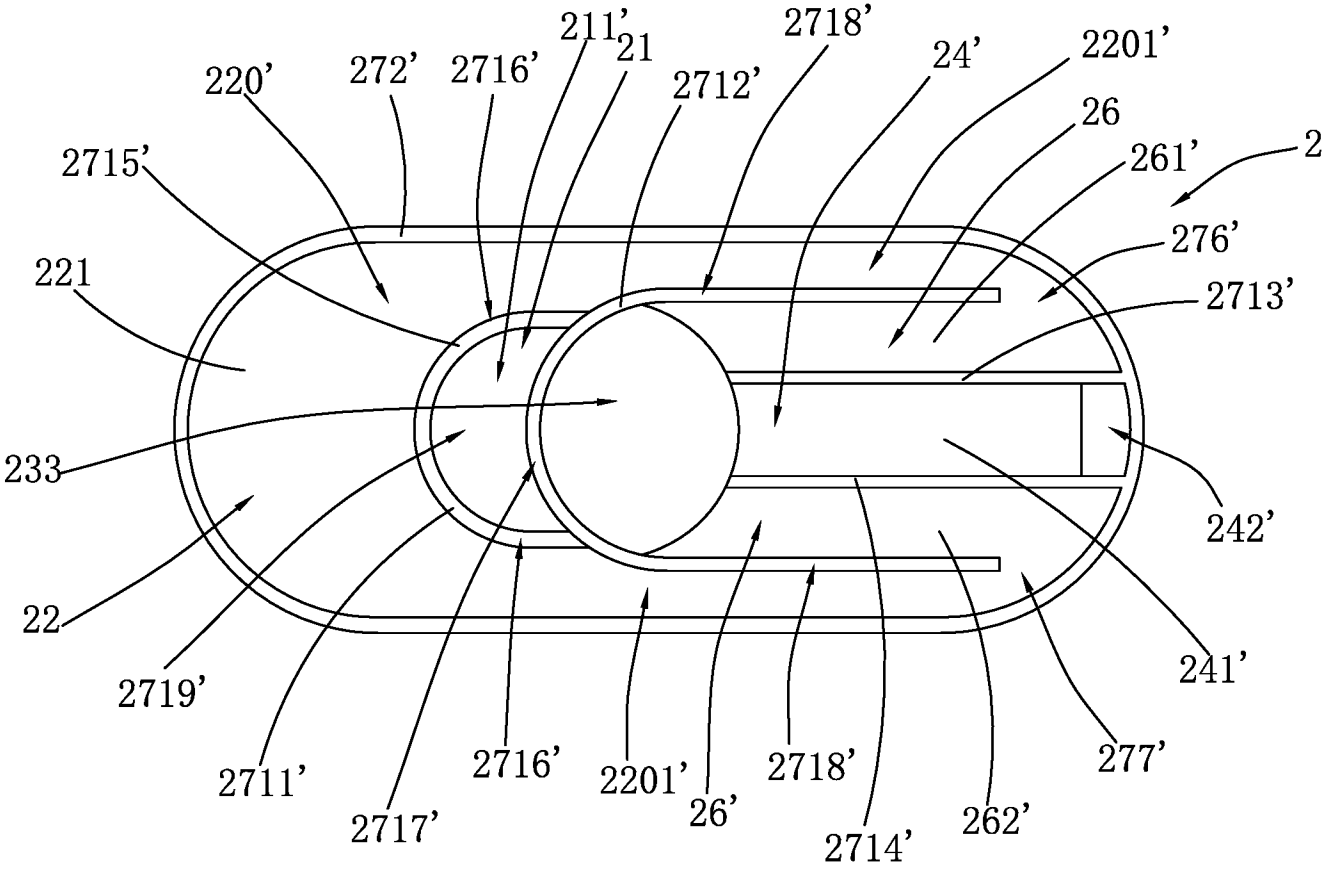
FIG. 33 is a plan view of the bottle arrangement according to the eighth preferred embodiment of the present invention.

As shown in FIG. 33 of the drawings, the first partitioning wall 2711' has a first curved portion 2715' and two first extension portions 2716' extended from the first curved portion 2715' to define a substantially U-shaped cross section of the first portioning wall 2711', which upwardly extends from the guiding base assembly 271'. The second partitioning wall 2712' has a second curved portion 2717' and two second extension portions 2718' extended from the second curved portion 2717' to define a substantially U-shaped cross section of the second partitioning wall 2712'. Two ends of the first partitioning wall 2711' are connected to the second curved portion 2717' of the second partitioning wall 2712' to form a partitioning cavity 2719' between the second curved portion 2717' of the second partitioning wall 2712' and the first partitioning wall 2711'. Thus, the partitioning cavity 2719' is a portion of the bucket cavity 273'.

As a result, the first compartment 22 is formed in the space bounded by the first compartment base 221, the first partitioning wall 2711', the surrounding rim 272', and the two second extension portions 2718' of the second partitioning wall 2712'. In view of this, the first compartment 22 also has a substantially U-shaped cross section having a main portion 220' formed at the overturning side 201' of the measuring bucket 2, and two contracted portions 2201' extended from the main portion 220' along a longitudinal direction of the measuring bucket 2. The two contracted portions 2201' extend from the overturning side 201' to the backflow side 202' of the measuring bucket 2.

The third partitioning wall 2713' and the fourth partitioning wall 2714' spacedly extend along a longitudinal direction of the measuring bucket 2 on the guiding base assembly 271' at a position between the two second extension portions 2718' of the second partitioning wall 2712' so as to define the first communicating channel 26, the second communicating channel 26', and the backflow channel 24 in the manner described above. In addition, according to the eighth embodiment of the present invention, the third partitioning wall 2713', the fourth partitioning wall 2714' and the two second extension portions 2718' of the second partitioning wall 2712' are substantially parallel to each other.

The measuring bucket 2 further has a through first inlet opening 211' formed on the guiding base assembly 271' and communicate with the partitioning cavity 2719' formed by the first partitioning wall 2711' and the second partitioning wall 2712'. When the bottle arrangement is overturned towards the overturning side 201', fluid in the bottle body 1 is arranged to enter the first compartment 22 through the first inlet opening 211' and the partitioning cavity 2719'.

The measuring bucket 2 further comprises a second compartment base 231 having a second compartment 23 downwardly extended from the guiding base assembly 271' to accommodate in the bottle body 1. Accordingly, the measuring bucket 2 further has a through second inlet opening 233 formed on the guiding base assembly 271' and communicating with the second compartment 23 of the second compartment base 231. Moreover, as shown in FIG. 27 and FIG. 33 of the drawings, liquid flowing in the first communicating channel 26 and the second communicating channel 26' is capable of flowing into the second compartment 23 through the second inlet opening 233.

As shown in FIG. 27 to FIG. 33 of the drawings, the measuring bucket 2 further has a backflow opening 242' formed at an end portion of the backflow channel 24', and a backflow guiding member 243' downwardly and inclinedly extended from the surrounding rim 272' of the measuring bucket 2 to the lower engagement member 28'. The backflow guiding member 243' has a backflow guiding channel 244' formed therein, wherein the backflow guiding channel 244' communicates with the backflow channel 24 through the backflow opening 242'. Furthermore, the lower engagement member 28' further has a return opening 283' formed on the outer boundary 281' and communicating with the central cavity 282'. Thus, the liquid flowing in the backflow channel 24' may be guided to flow into the backflow guiding channel 244' through the backflow opening 242'. The liquid flowing in the backflow guiding channel 244' is guided to flow through the return opening 283' and eventually reaches the central cavity 282'. Once in the central cavity 282', the liquid naturally returns to the receiving chamber 13 of the bottle body 1 by gravitational force.

Figure 29:
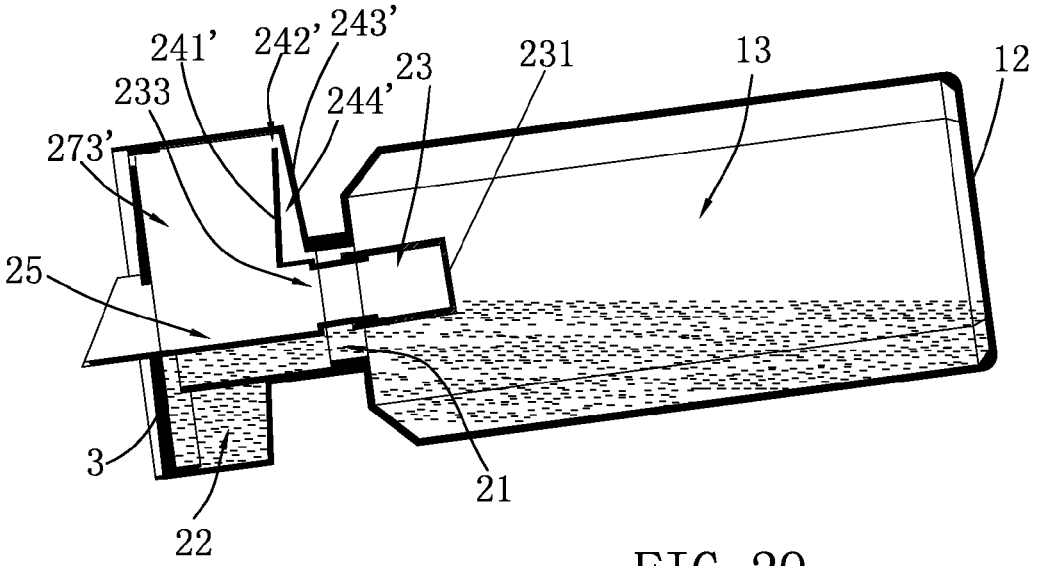
FIG. 29 is a sectional view illustrating the bottle arrangement being overturned for a first time according to the eighth preferred embodiment of the present invention.
Figure 30:
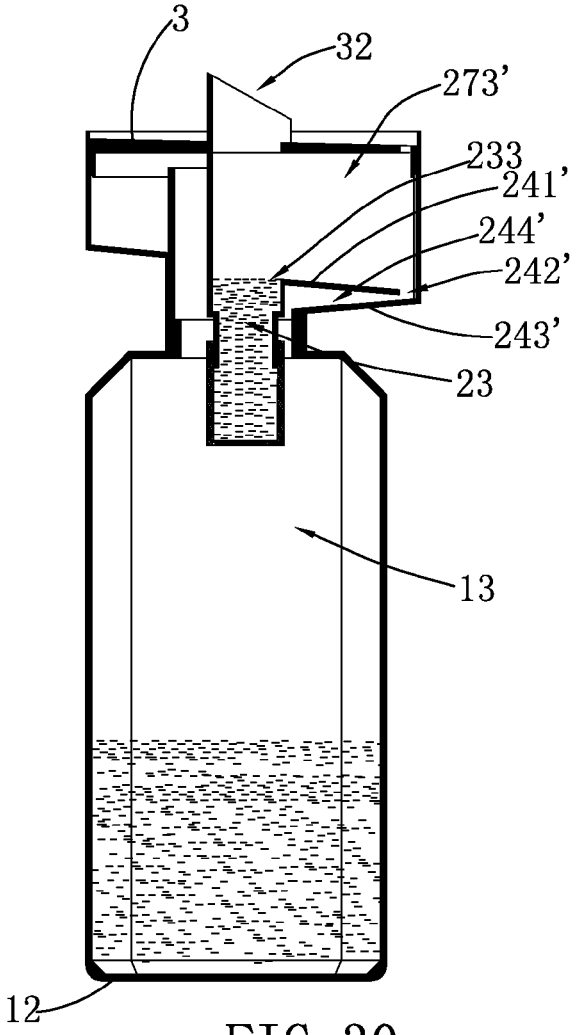
FIG. 30 is a sectional view illustrating the bottle arrangement being overturned for a second time according to the eighth preferred embodiment of the present invention.
Figure 31:
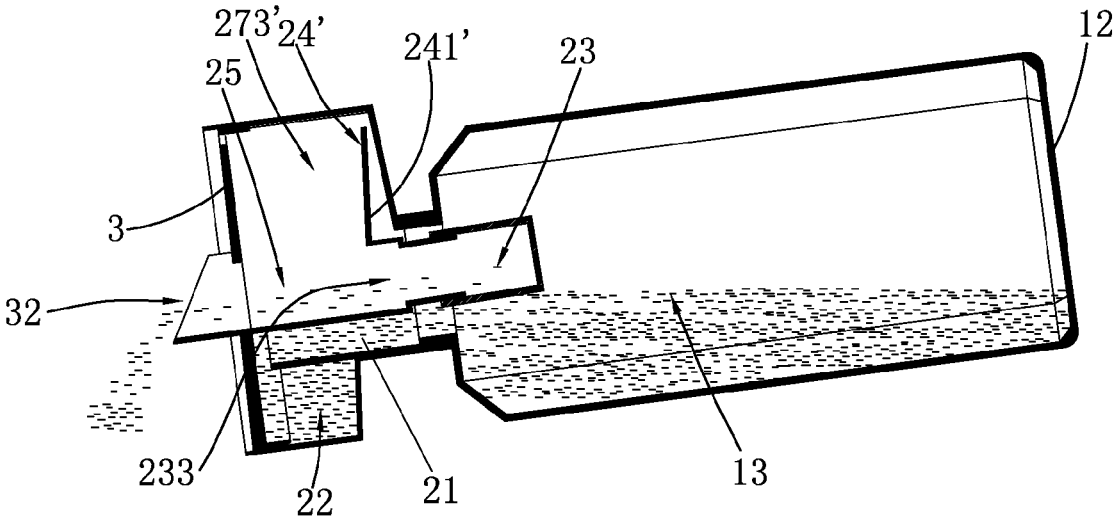
FIG. 31 is a sectional view illustrating the bottle arrangement being overturned for a third time according to the eighth preferred embodiment of the present invention.

As shown in FIG. 29 and FIG. 30 of the drawings, the second inlet opening 233, the flow guiding opening 32 and the space formed between these two openings constitute the discharge channel 25 of the liquid.

According to the eighth preferred embodiment of the present invention, the first compartment base 221 has a predetermined inclination with respect to horizontal. As shown in FIG. 27 and FIG. 30 of the drawings, the first compartment base 221 is inclined downwardly from the overturning side 201' to the backflow side 202' so that when the bottle arrangement of the present invention is placed on a horizontal surface, liquid contained in the first compartment 22 is naturally guided by gravitational force to flow towards the backflow side 202'. Thus, the guiding base assembly 271' further has a first communicating openings 276' communicating the corresponding contracted portion 2201' of the first compartment 22 with the first communicating channel 26, and a second communicating opening 277' communicating another contracted portion 2202' of the first compartment 22 with the second communicating channel 26'. The liquid flowing in the first compartment 22 may be guided to enter the first communicating channel 26 and the second communicating channel 261' through the first and the second communicating openings 276', 277'. In the eighth preferred embodiment of the present invention, the first communicating opening 276' is formed in a space between an outer end of the corresponding second extension portion 2718' of the second partitioning wall 2712' and the surrounding rim 272', while the second communicating opening 277' is formed in a space between another outer end of the corresponding second extension portion 2718' of the second partitioning wall 2712' and the surrounding rim 272'.

Moreover, each of the first channel base 261' and the second channel base 262' is downwardly inclined from the backflow side 202' of the measuring bucket 2 to the second inlet opening 233 (i.e. towards the overturning side of the measuring bucket 2). When the bottle arrangement is placed horizontally, the liquid entering and flowing in the first communicating channel 26 and the second communicating channel 26' is naturally guided by gravitational force to flow through the second inlet opening 233 and eventually reach the second compartment 23.

It is important to point out that the backflow channel base 241' is downwardly inclined from the second inlet opening 233 to the backflow opening 242' positioned at the backflow side 202' of the measuring bucket 2. When the bottle arrangement is placed horizontally, the liquid flowing in the backflow channel 24 (which may be excessive liquid coming from the second compartment 23) is naturally guided by gravitational force to flow from the second inlet opening 233 to the backflow opening 242' and eventually reach the backflow guiding member 243'.

As a result, the first compartment base 221, the first channel base 261', the second channel base 262', the backflow channel base 241' and the backflow guiding member 243' form or resemble a zigzag flowing path for the liquid flowing in the measuring bucket 2.

The operation of the present invention is illustrated in FIG. 29 to FIG. 32 and is described as follows: the bottle arrangement of the present invention is arranged to be sequentially operated in three positions for discharging a predetermined amount of the liquid stored in the receiving chamber 13. Initially, a predetermined amount of liquid is stored in the receiving chamber 13 of the bottle body 1. When a user wishes to retrieve a certain amount of liquid from the bottle body 1, he needs to tilt or overturn the bottle body 1 towards the overturning side 201'. When the bottle body 1 and the measuring bucket 2 are overturned towards the overturning side 201' (first position), the liquid is guided to flow into the first compartment 22 through the first inlet opening 21' and the partitioning cavity 2719', as shown in FIG. 29 of the drawings.

When the first compartment 22 is filled by the liquid, the user needs to put the bottle body 1 back to the vertical position as in FIG. 30 (second position). The liquid from the first compartment 22 is then guided to flow along the first compartment base 221 which is downwardly inclined from the overturning side 201' towards the backflow side 202', and enters the first communicating channel 26 and the second communicating channel 26' through the first communicating opening 276' and the second communicating opening 277'. The liquid is then guided to flow along the first channel base 261' and the second channel base 262', which are downwardly inclined from the backflow side 202' towards the overturning side 201'. The liquid is then guided to flow into the second compartment 23 through the second inlet opening 233. The second compartment 23 is rapidly filled with liquid coming from the first compartment 22. The liquid is temporarily stored in the second compartment base 231 and is ready for discharge.

Figure 32:
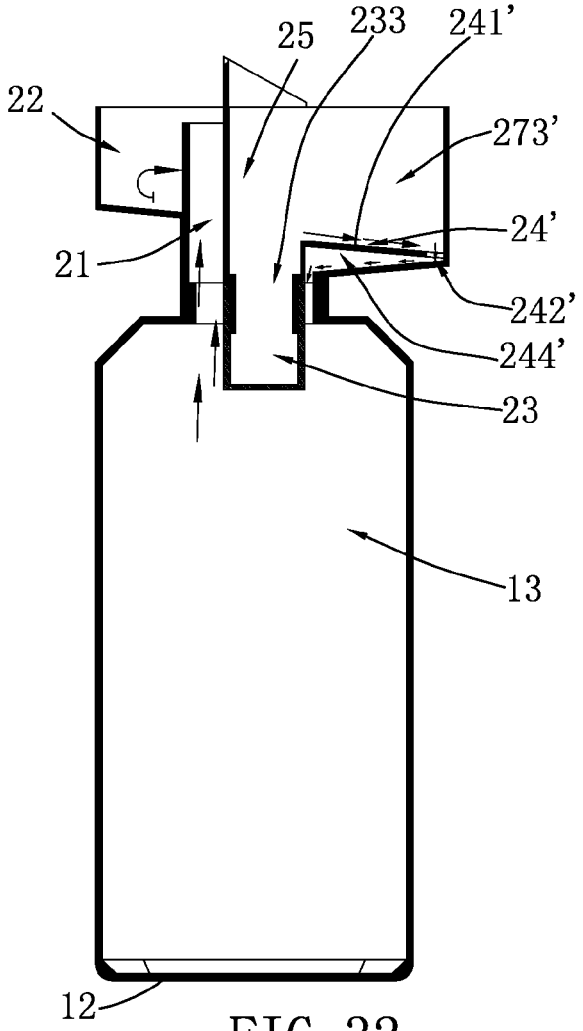
FIG. 32 is a sectional view of the bottle arrangement according to the eighth preferred embodiment of the present invention.

At the same time, as shown in FIG. 30 and FIG. 32 of the drawings, excessive liquid contained in the second compartment 23 is guided to flow along the backflow channel base 241' which is downwardly inclined from the overturning side 201' towards the backflow side 202' of the bottle body 1. The excessive liquid is then allowed to pass through the backflow opening 242' and reaches the backflow guiding member 243', which is provided underneath the backflow channel base 241' and downwardly inclined from the backflow side 202' towards the overturning side 201'. As a result, the liquid is guided to flow along the backflow guiding channel 244' and passes through the returning opening 283' of the lower engagement member 28' and eventually flows back to the receiving chamber 13, as shown in FIG. 32 of the drawings. Note that the returning opening 283' is provided on the lower engagement member 28' at a position opposite to the first inlet opening 21.

In order to discharge the liquid stored in the second compartment 32, the user has to overturn the bottle body 1 again in the direction of the overturning side 201' (third position, see FIG. 31) so that the liquid stored in the second compartment 23 is guided by natural gravitational force to flow along the discharge channel 25 and passes through the second inlet opening 233 and the flow guiding opening 32 and eventually reaches an exterior of the bottle arrangement. It is worth mentioning that when the bottle body 1 is overturned for discharging the liquid stored in the second compartment 23, the remaining liquid stored in the receiving chamber 13 is simultaneously guided to flow into the first compartment 22 in the same manner described above. As such, liquid is continuously measured and discharged by the second compartment base 231 and from the second compartment 23.

Therefore, the volume discharged by the measuring bucket 2 is fixed and is identical to the volume of the second compartment 23. The user may then be able to retrieve an identical amount of liquid by using the bottle arrangement of the present invention.

It is worth mentioning, as an alternative mode to the eighth preferred embodiment of the present invention, that the measuring bucket 2 can still function without the second communicating channel 26' and the contracted portion 2201' which is adjacently extended along the second communicating channel 26'. In the eighth preferred embodiment, the measuring bucket 2 is symmetrical about a longitudinal axis thereof. As a result, only one side of the symmetrical axis is needed for the measuring bucket 2 to function. This constitutes an alternative of the eighth preferred embodiment.

Thus, the bottle arrangement in this alternative mode of the eighth preferred embodiment of the present invention may comprise a bottle body 1 and a measuring bucket 2. The bottle body 1 has a receiving chamber 13 for storing a predetermined amount of liquid, and a bottle opening 14.

The measuring bucket 2 has an overturning side 201' and an opposed backflow side 202', and may comprise a guiding base assembly 271' which comprises an inclined first compartment base 221, an inclined first channel base 261', and an inclined backflow channel base 241'. The guiding base assembly 271' has a through first inlet opening 21, a through second inlet opening 272, a backflow opening 224, and a first communicating opening 276'. The first inlet opening 21 and the backflow opening 224 communicate with the receiving chamber 13 of the bottle body 1.

The measuring bucket 2 further comprises first through third partitioning walls 2711', 2713', 2713' provided on the guiding base assembly 271' to define at least a first compartment 22 having the first compartment base 221, a first communicating channel 26 having the first channel base 261', and a backflow channel 24 having the backflow channel base 241', the backflow opening 224 being formed on the backflow channel base 241' at the backflow side 202' of the measuring bucket 2. The first communicating opening 276' communicates the first compartment 22 with the first communicating channel 26.

The bottle arrangement is arranged to be sequentially operated in three positions for discharging a predetermined amount of the liquid stored in the receiving chamber 13.

In the first position, the bottle arrangement is flipped towards the overturning side 201', and the liquid stored in the receiving chamber 13 is arranged to flow into the first compartment 22 through the first inlet opening 21.

In the second position, the bottle arrangement is flipped towards the backflow side 202' so as to allow the bottle arrangement to stand vertically. The liquid in the first compartment 22 is guided by the first compartment base 221 to flow through the first communicating channel 26 and the second inlet opening 272 and eventually stored in the second compartment 23 of the second compartment base 231. Excessive liquid from the second compartment 23 is arranged to be guided to return to the receiving chamber 13 through flowing through the backflow channel 24 and the backflow opening 224.

In the third position, the bottle arrangement is again flipped towards the overturning side, so that the liquid stored in the second compartment 23 is arranged to be guided to flow through the second inlet opening 272 and the flow guiding opening 32 of the top cap 3 and is discharged out of the bottle arrangement.

In the above manner, the measuring bucket 2 can also function even without the second communicating channel 26' and the corresponding contracted portion 2701' of the first compartment The present invention, while illustrated and described in terms of a preferred embodiment and several alternatives, is not limited to the particular description contained in this specification. Additional alternative or equivalent components could also be used to practice the present invention.

What is claimed is:

1. A bottle arrangement, comprising:

a bottle body having a receiving chamber for storing a predetermined amount of liquid, and a bottle opening;

a measuring bucket having an overturning side and an opposed backflow side, and comprising:

a guiding base assembly which comprises an inclined first compartment base, an inclined first channel base, and an inclined backflow channel base, said guiding base assembly having a through first inlet opening, a through second inlet opening, a backflow opening, and a first communicating opening, said first inlet opening and said backflow opening communicating with said receiving chamber of said bottle body;

first through third partitioning walls provided on said guiding base assembly to define at least a first compartment having said first compartment base, a first communicating channel having said first channel base, and a backflow channel having said backflow channel base, said backflow opening being formed on said backflow channel base at said backflow side of said measuring bucket, said first communicating opening communicating said first compartment with said first communicating channel;

a second compartment base downwardly extended from said guiding base assembly, said second compartment base having a second compartment communicating with said second inlet opening of said guiding base assembly; and a top cap having a sealing portion and a through flow guiding opening formed thereon, said flow guiding opening has a longitudinal axis aligning with that of said second inlet opening;

whereby, said bottle arrangement is arranged to be sequentially operated in three positions for discharging a predetermined amount of said liquid stored in said receiving chamber;

wherein in said first position, said bottle arrangement is flipped towards said overturning side, and said liquid stored in said receiving chamber is arranged to flow into said first compartment through said first inlet opening;

wherein in said second position, said bottle arrangement is flipped towards said backflow side so as to allow said bottle arrangement to stand vertically, said liquid in said first compartment is guided by said first compartment base to flow through said first communicating channel and said second inlet opening and eventually stored in said second compartment of said second compartment base, excessive liquid from said second compartment is arranged to be guided to return to said receiving chamber through flowing through said backflow channel and said backflow opening; and wherein in said third position, said bottle arrangement is again flipped towards said overturning side, so that said liquid stored in said second compartment is arranged to be guided to flow through said second inlet opening and said flow guiding opening of said top cap and is discharged out of said bottle arrangement.

2. The bottle arrangement, as recited in claim 1, said guiding assembly further comprising an inclined second channel base and a second communicating opening, said measuring bucket further comprising a fourth partitioning wall to define a second communicating channel having said second channel base, said first communicating channel and said second communicating channel being formed at a position sandwiched by said first compartment, said backflow channel being formed at a position between said first communicating channel and said second communicating channel, said second communicating opening communicating said first compartment with said second communicating channel.

3. The bottle arrangement, as recited in claim 2, wherein each of said first compartment base, said first channel base, and second channel base, and said backflow channel base has a predetermined slope such that liquid flowing on said first compartment base, said first channel base, said second channel base and said backflow channel base is guided by natural gravitational force to flow in a descending direction.

4. The bottle arrangement, as recited in claim 3, wherein said first compartment base is downwardly and inclinedly extended from said overturning side to said backflow side.

5. The bottle arrangement, as recited in claim 2, wherein said first communicating channel is formed in a space bounded by said second partitioning wall, said third partitioning wall, and said first channel base.

6. The bottle arrangement, as recited in claim 5, wherein said second communicating channel is formed in a space bounded by said second partitioning wall, said fourth partitioning wall, and said second channel base.

7. The bottle arrangement, as recited in claim 6, wherein each of said first channel base and said second channel base is downwardly and inclinedly extended from said backflow side of said measuring bucket towards said overturning side of said measuring bucket.

8. The bottle arrangement, as recited in claim 2, wherein said backflow channel is formed in a space bounded by said third partitioning wall, said fourth partitioning wall, and said backflow channel base.

9. The bottle arrangement, as recited in claim 8, wherein said backflow channel base is downwardly and inclinedly extended from said second inlet opening to said backflow opening positioned at said backflow side of said measuring bucket.

10. The bottle arrangement, as recited in claim 2, wherein said first partitioning wall has a first curved portion and two first extension portions extended from said first curved portion to define a substantially U-shaped cross section of said first partitioning wall, said second partitioning wall having a second curved portion and two second extension portions extended from said second curved portion to define a substantially U-shaped cross section of said second partitioning wall, two ends of said first partitioning wall being connected to said second curved portion of said second partitioning wall to form a partitioning cavity between said second curved portion of said second partitioning wall and said first partitioning wall.

11. The bottle arrangement, as recited in claim 10, wherein said first compartment is formed in a space bounded by said first compartment base, said first partitioning wall, said surrounding rim, and said two second extension portions of said second partitioning wall, said first compartment having a substantially U-shaped cross section having a main portion formed at said overturning side of said measuring bucket, and two contracted portions extended from said main portion along a longitudinal direction of said measuring bucket, in such a manner that said two contracted portions extend from said overturning side to said backflow side of said measuring bucket.

12. The bottle arrangement, as recited in claim 11, wherein said third partitioning wall and said fourth partitioning wall spacedly extend along a longitudinal direction of said measuring bucket on said guiding base assembly at a position between said two second extension portions of said second partitioning wall so as to define said first communicating channel, said second communicating channel, and said backflow channel.

13. The bottle arrangement, as recited in claim 12, wherein said first inlet opening being formed on said guiding base assembly and communicating with said partitioning cavity formed by said first partitioning wall and said second partitioning wall.

14. The bottle arrangement, as recited in claim 13, wherein said first communicating openings communicates said corresponding contracted portion of said first compartment with said first communicating channel, said second communicating opening communicating another contracted portion of said first compartment with said second communicating channel.

15. The bottle arrangement, as recited in claim 2, wherein said measuring bucket further comprises a lower engagement member downwardly extended from a bottom side of said guiding base assembly, said lower engagement member comprising an outer boundary and a central cavity bounded by said outer boundary.

16. The bottle arrangement, as recited in claim 15, wherein said measuring bucket further comprises a backflow guiding member downwardly and inclinedly extended from said surrounding rim of said measuring bucket to said lower engagement member, said backflow guiding member having a backflow guiding channel communicating with said backflow channel through said backflow opening.

17. The bottle arrangement, as recited in claim 16, wherein said lower engagement member further has a return opening formed on said outer boundary and communicated with said central cavity, so that liquid flowing in said backflow channel is guided to flow into said backflow guiding channel through said backflow opening, and is then guided to flow through said return opening and eventually reaches said central cavity and said receiving chamber.

18. The bottle arrangement, as recited in claim 17, wherein said measuring bucket further comprises a surrounding rim circumferentially and upwardly extended from along a side edge of said guiding base assembly to define a bucket cavity in a space confined by said guiding base assembly, said surrounding rim, and said top cap, said flow guiding opening communicating said bucket cavity with an exterior of said measuring bucket.

19. The bottle arrangement, as recited in claim 2, wherein said measuring bucket further comprises a surrounding rim circumferentially and upwardly extended from along a side edge of said guiding base assembly to define a bucket cavity in a space confined by said guiding base assembly, said surrounding rim, and said top cap, said flow guiding opening communicating said bucket cavity with an exterior of said measuring bucket.

20. The bottle arrangement, as recited in claim 2, wherein said bottle body further comprises an engagement rim upwardly protruded from said bottle body, said bottle opening being formed within said engagement rim.

* * * * *